US011025008B2

(12) United States Patent
Kim et al.

(10) Patent No.: US 11,025,008 B2
(45) Date of Patent: Jun. 1, 2021

(54) BOARD TO BOARD CONNECTOR

(71) Applicant: MPD Corp., Incheon (KR)

(72) Inventors: Yong-Il Kim, Gyeonggi-do (KR); Deog-Su Han, Gyeonggi-do (KR); Hyun-Hwa So, Incheon (KR)

(73) Assignee: MPD Corp., Incheon (KR)

( * ) Notice: Subject to any disclaimer, the term of this patent is extended or adjusted under 35 U.S.C. 154(b) by 0 days.

(21) Appl. No.: 16/662,854

(22) Filed: Oct. 24, 2019

(65) Prior Publication Data

US 2020/0136314 A1 Apr. 30, 2020

(30) Foreign Application Priority Data

Oct. 25, 2018 (KR) ..... 10-2018-0128279
Jun. 4, 2019 (KR) ..... 10-2019-0066255
Aug. 6, 2019 (KR) ..... 10-2019-0095683

(51) Int. Cl.
*H01R 13/631* (2006.01)
*H01R 12/71* (2011.01)
(Continued)

(52) U.S. Cl.
CPC ..... *H01R 13/6315* (2013.01); *H01R 12/716* (2013.01); *H01R 13/052* (2013.01); *H01R 13/15* (2013.01); *H01R 13/508* (2013.01)

(58) Field of Classification Search
CPC H01R 13/6315; H01R 12/716; H01R 13/052; H01R 13/15; H01R 13/508;
(Continued)

(56) References Cited

U.S. PATENT DOCUMENTS 5,516,303 A * 5/1996 Yohn ..... H01R 13/6315 439/248
5,769,652 A * 6/1998 Wider ..... H01R 13/6315 439/248
(Continued)

FOREIGN PATENT DOCUMENTS

CN 1407661 A 4/2003
CN 101420091 A 4/2009
(Continued)

OTHER PUBLICATIONS

Office Action issued by the Korean Intellectual Property Office dated Oct. 8, 2019.
(Continued)

*Primary Examiner* — Travis S Chambers
(74) *Attorney, Agent, or Firm* — IP & T Group LLP

(57) ABSTRACT

A board to board connector may include: a first shell coupled to a first board, and including a protruding extension part extended upward in a longitudinal direction and having one end protruding in a radial direction; and a second shell including an elastic rotating part extended downward in the longitudinal direction toward between a cover part and the protruding extension part, and having one end protruding in the radial direction so as to be engaged with and fixed to the protruding extension part. The elastic rotating part may be spaced apart from the cover part, made of an elastic material, and rotatable from side to side in a movement space formed between the elastic rotating part and the cover part.

15 Claims, 26 Drawing Sheets

(51) Int. Cl.
*H01R 13/05* (2006.01)
*H01R 13/15* (2006.01)
*H01R 13/508* (2006.01)

(58) Field of Classification Search
CPC ..... H01R 12/52; H01R 12/00; H01R 24/50; H01R 13/28; H01R 24/84; H01R 12/73; H01R 12/91; H01R 13/627; H01R 13/502; H01R 12/7005; H01R 13/24
USPC ..... 439/66, 63, 65, 74, 83, 246, 284, 295
See application file for complete search history.

(56) References Cited

U.S. PATENT DOCUMENTS

| | | | | |
|---|---|---|---|---|
| 6,224,390 | B1 * | 5/2001 | Mitani | H01R 13/6315 439/63 |
| 6,558,177 | B2 * | 5/2003 | Havener | H01R 13/6315 439/246 |
| 6,699,054 | B1 * | 3/2004 | Critelli | H01R 13/6315 439/248 |
| 6,758,680 | B2 * | 7/2004 | Duquerroy | H01R 24/50 439/63 |
| 6,776,668 | B1 * | 8/2004 | Scyoc | H01R 13/2421 439/295 |
| 7,416,418 | B2 * | 8/2008 | Berthet | H01R 12/91 439/66 |
| 9,373,990 | B2 * | 6/2016 | Lutz | H01R 39/27 |
| 9,429,179 | B2 * | 8/2016 | Tran | F16B 21/10 |
| 9,484,650 | B2 * | 11/2016 | Shinder-Lerner | H01R 12/91 |
| 10,622,765 | B2 * | 4/2020 | Song | H01R 13/6471 |
| 2009/0149086 | A1 * | 6/2009 | Dahms | H01R 12/52 439/835 |
| 2012/0282804 | A1 | 11/2012 | Rodrigues et al. | |
| 2014/0030915 | A1 * | 1/2014 | Perrin | H01R 24/50 439/578 |

FOREIGN PATENT DOCUMENTS

| | | | |
|---|---|---|---|
| CN | 104321938 | A | 1/2015 |
| CN | 104852180 | A | 8/2015 |
| CN | 108173092 | A | 6/2018 |
| JP | 3035541 | B1 | 4/2000 |
| JP | 2007087682 | A | 4/2007 |
| JP | 2009-056852 | | 3/2009 |
| JP | 2017-033832 | | 2/2017 |
| JP | 2017-059337 | | 3/2017 |
| KR | 10-2012-0127619 | | 11/2012 |
| KR | 10-1301772 | | 8/2013 |
| KR | 10-2013-0098047 | | 9/2013 |
| KR | 10-1476570 | | 12/2014 |
| KR | 10-1921128 | | 11/2018 |
| KR | 10-2019-0060662 | | 6/2019 |

OTHER PUBLICATIONS

Office Action issued by the Korean Intellectual Property Office dated Jul. 9, 2019.
Notice of Allowance issued by the Korean Intellectual Property Office dated Sep. 3, 2019.
Office Action issued by the China National Intellectual Property Administration dated Dec. 28, 2020.

* cited by examiner

BOARD TO BOARD CONNECTOR

CROSS-REFERENCE TO RELATED APPLICATION

This application claims priority under 35 U.S.C. § 119 to Korean Patent Application Nos. 10-2018-0128279, 10-2019-0066255 and 10-2019-0095683 filed on Oct. 25, 2018, Jun. 4, 2019, and Aug. 6, 2019, respectively, which are incorporated herein by reference in their entirety.

BACKGROUND

1. Technical Field

The present disclosure relates to a board to board connector, and more particularly, to a board to board connector which can flexibly rotate in top-to-bottom and side-to-side directions when the two boards are coupled, and improve the parallelism between the two boards to provide a stable connection of the connector.

2. Discussion of the Related Art

In general, various signals are transmitted between wired/wireless communication devices, and a connector is used to electrically connect communication devices between which signals are transmitted.

The connector couples target devices to transfer an electrical signal and a ground voltage between the target devices. For example, the connector may be used to couple printed circuit boards, couple a printed circuit board and a coaxial cable, or couple coaxial cables.

Among the couplings, 'coupling between printed circuit boards' indicates a process of stacking a plurality of printed circuit boards and electrically connecting the stacked printed circuit boards by coupling a plurality of connectors and a plurality of terminals between the respective printed circuit boards, in order to efficiently use a limited space.

As the related art used for the coupling between printed circuit boards, Korean Patent No. 10-1301772 discloses a board to board radio frequency (RF) connector including a connector part which is formed on one side thereof and can be rotated, bent and moved upward/downward.

Referring to FIG. 1 illustrating the RF connector according to the related art, the RF connector includes a connector part 3 fixed to a first board 1 and having an interface part 2, and a terminal part 6 fixed to a second board 4 and having a fixation hole 5 to which the interface part 2 is inserted and fixed. The connector part 3 has spiral grooves 8 which are cut in a spiral shape and formed in the center of a case 7, such that an upper part of the case 7 can be rotated by 360 degrees with a lower part of the case 7 fixed to the first board 1. The spiral grooves 8 serve to provide an elastic restoring force in the top-to-bottom direction.

However, for the spiral grooves 8 in the related art, a separate manufacturing process is required to form spiral grooves in the center of the case 7. Furthermore, since the spiral grooves 8 mainly provide the elastic restoring force in the top-to-bottom direction, there is a limitation in flexibly rotating the case 7 in the side-to-side direction.

Therefore, when an excessive coupling force is applied in the side-to-side direction while boards are coupled to each other, the case 7 may be permanently deformed, and damage of an inserted pin may be caused. For example, the inserted pin may be bent.

SUMMARY

Various embodiments are directed to a board to board connector which can flexibly rotate in top-to-bottom and side-to-side directions when the two boards are coupled, and provide a stable connection of the connector, under the supposition that an elastic rotating part of an upper shell can easily rotate the upper shell in the side-to-side direction.

Also, various embodiments are directed to a board to board connector capable of improving a load acceptance capacity of a spring disposed between shells of the connector connecting two boards.

Also, various embodiments are directed to a board to board connector capable of preventing relative rotation between shells of the connector connecting two boards.

Also, various embodiments are directed to a board to board connector which can improve the parallelism between shells of the connector, thereby improving the parallelism between two boards connected by connector.

Also, various embodiments are directed to a board to board connector which provides a stopper function to prevent a multipoint support plate spring from contracting by a predetermined amount or more, the multipoint support plate spring providing a buffering force between shells of the connector connecting two boards.

In a first embodiment, a board to board connector may include: a first shell coupled to a first board, and including a protruding extension part extended upward in a longitudinal direction and having one end protruding in a radial direction; and a second shell including an elastic rotating part extended downward in the longitudinal direction toward between a cover part and the protruding extension part, and having one end protruding in the radial direction so as to be engaged with and fixed to the protruding extension part. The elastic rotating part may be spaced apart from the cover part, made of an elastic material, and rotatable from side to side in a movement space formed between the elastic rotating part and the cover part.

The board to board connector may further include a contact pin serving as a central conductor passing through the first and second shells.

In the board to board connector, the elastic rotating part may be made of an elastic material and have one or more slots formed in the longitudinal direction along the circumference thereof in order to facilitate side-to-side rotation of the second shell.

The board to board connector may further include a plate spring disposed in the movement space between the elastic rotating part and the cover part.

In the board to board connector, a portion of the plate spring may be bent toward the elastic rotating part.

In the board to board connector, the plate spring may be contacted with the inner wall of the cover part up to the middle portion of the inner wall of the cover part, and spaced apart from the inner wall of the cover part past the middle portion of the inner wall of the cover part, such that a portion of the plate spring is bent toward the protruding one end of the elastic rotating part.

The board to board connector may further include an O-ring disposed in the movement space between the elastic rotating part and the cover part.

The board to board connector may further include a spring disposed between the cover part and a spring cap located at the bottom of the first shell, in order to rotate the second shell in the top-to-bottom direction.

The board to board connector may further include a terminal part coupled and fixed to the second board and inserted and fixed to the upper portion of the second shell.

In the board to board connector, a contact pin may include a first terminal and a second terminal. The first terminal may be disposed on the inside of the first shell, and the second terminal may be disposed on the inside of the second shell. One end of the second terminal may be formed in a spherical shape, and inserted and mounted into a longitudinal insertion space of the first terminal, such that the second terminal can be rotated in the top-to-bottom and side-to-side directions according to top-to-bottom and side-to-side rotations of the second shell.

In a second embodiment, a board to board connector may include a first connector part including a first shell formed in a cylindrical shape and having slots partially formed therein, a first terminal and a first insulator; and a second connector part including a second shell formed in a cylindrical shape, a second terminal, a second insulator, a spring and an elastic member. The elastic member may be formed in the second shell, have a press structure based on a multi-forming structure, include a plurality of slots formed therein, and have a diameter that decreases from bottom toward top.

In a third embodiment, a board to board connector may include: a first shell coupled to a first board, and including a protruding extension part extended upward in a longitudinal direction and having one end protruding in a radial direction; a second shell including an elastic rotating part extended downward in the longitudinal direction toward between a cover part and the protruding extension part, and having one end protruding in the radial direction so as to be engaged with and fixed to the protruding extension part; and a volute spring disposed between a lower end surface of the cover part of the second shell and a lower flange of the first shell, in order to push the second shell upward with respect to the first shell.

In the board to board connector, the elastic rotating part may be spaced apart from the cover part, made of an elastic material, and rotatable from side to side in a movement space formed between the elastic rotating part and the cover part.

In the board to board connector, the volute spring may have an inner diameter equal to or larger than that of the lower end surface of the cover part of the second shell, and have an outer diameter equal to or smaller than that of the lower flange of the first shell.

In the board to board connector, a first protrusion onto which the outside of a lower end of the volute spring is inserted may be formed on a top surface of the lower flange of the first shell. A second protrusion which is inserted into an upper end of the volute spring may be formed on the lower end surface of the cover part of the second shell.

In a fourth embodiment, a board to board connector may include: a first shell coupled to a first board, and including a protruding extension part extended upward in a longitudinal direction and having one end protruding in a radial direction; a second shell including an elastic rotating part extended downward in the longitudinal direction toward between a cover part and the protruding extension part, and having one end protruding in the radial direction so as to be engaged with and fixed to the protruding extension part; and a multipoint support plate spring disposed between a lower end surface of the cover part of the second shell and a lower flange of the first shell, in order to push the second shell upward with respect to the first shell. The elastic rotating part may be spaced apart from the cover part, made of an elastic material, and rotatable from side to side in a movement space formed between the elastic rotating part and the cover part.

In the board to board connector, the multipoint support plate spring may include an inner circular band, a plurality of extension parts extended outward from an outer edge of the inner circular band, and a plurality of legs protruding upward obliquely from the extension parts.

In the board to board connector, the multipoint support plate spring may include three or more extension parts and three or more legs.

In the board to board connector, the plurality of legs which protrude obliquely may have an inflection part formed in the middle thereof, at which the slope is changed, and include end portions which are horizontally formed.

In the board to board connector, the inner circular band and the extension parts of the multipoint support plate spring may be engaged with seating parts formed on the top surface of the lower flange of the first shell. The end portions of the plurality of legs of the multipoint support plate spring may be engaged with seating parts formed on the lower end surface of the cover part of the second shell.

In the board to board connector, the end portions of the plurality of legs of the multipoint support plate spring may be extended downward by a predetermined length from the peak of the legs. When the second shell is moved toward the first shell, the end portions of the legs of the multipoint support plate spring may be contacted with the top surface of the lower flange of the first shell, and restrain the downward movement of the second shell.

The board to board connector may further include a stopper spring which includes an inner circular band, one or more extension parts extended outward from an outer edge of the inner circular band, and one or more stoppers protruding upward obliquely from the one or more extension parts and each having an end portion extended downward by a predetermined length from the peak of the stopper. The stopper spring may be disposed over or under the multipoint support plate spring at the top surface of the lower flange of the first shell. When the second shell is moved toward the first shell, the end portion of the stopper of the stopper spring may be contacted with the top surface of the lower flange of the first shell, and restrain the downward movement of the second shell.

The board to board connector may further include a stopper protruding outward from the outer circumferential surface of the lower end portion of the protruding extension part of the first shell, and having a predetermined height. When the second shell is moved toward the first shell, the lower end of the elastic rotating part of the second shell may be contacted with the stopper of the first shell, and restrain the downward movement of the second shell.

The board to board connector may further include a contact pin serving as a central conductor passing through the first and second shells.

In the board to board connector, the elastic rotating part may be formed of an elastic material and have one or more slots formed in the longitudinal direction along the circumference thereof in order to facilitate side-to-side rotation of the second shell.

The board to board connector may further include an O-ring disposed in the movement space between the elastic rotating part and the cover part.

The board to board connector may further include a jack-type connector coupled and fixed to the second board and inserted and fixed to the top of the second shell.

In the board to board connector, the contact pin may include a first terminal and a second terminal. The first terminal may be disposed on the inside of the first shell, and the second terminal may be disposed on the inside of the second shell. One end of the second terminal may be formed in a spherical shape, and inserted and mounted into a longitudinal insertion space of the first terminal, such that the second terminal can be rotated in the top-to-bottom and side-to-side directions according to top-to-bottom and side-to-side rotations of the second shell.

In the board to board connector, when the second shell is moved toward the first shell, the one end of the second terminal may be contacted with the bottom surface of an insertion space of the first terminal, and restrain the downward movement of the second shell.

In a fifth embodiment, a board to board connector may include: a first shell coupled to a first board, and including a protrusion extension part extended upward in a longitudinal direction and having one end protruding in a radial direction; a second shell including an elastic rotating part extended downward in the longitudinal direction toward between a cover part and the protruding extension part, and having one end protruding in the radial direction so as to be engaged with and fixed to the protruding extension part; and a wave spring disposed between a lower end surface of the cover part of the second shell and a lower flange of the first shell, in order to push the second shell upward with respect to the first shell. The elastic rotating part may be spaced apart from the cover part, made of an elastic material, and rotatable from side to side in a movement space formed between the elastic rotating part and the cover part.

The board to board connector may further include a contact pin serving as a central conductor passing through the first and second shells.

In the board to board connector, the contact pin may include a first terminal and a second terminal. The first terminal may be disposed on the inside of the first shell, and the second terminal may be disposed on the inside of the second shell. One end of the second terminal may be formed in a spherical shape, and inserted and mounted into a longitudinal insertion space of the first terminal, such that the second terminal can be rotated in the top-to-bottom and side-to-side directions according to the top-to-bottom and side-to-side rotations of the second shell.

DETAILED DESCRIPTION

Figure 1:
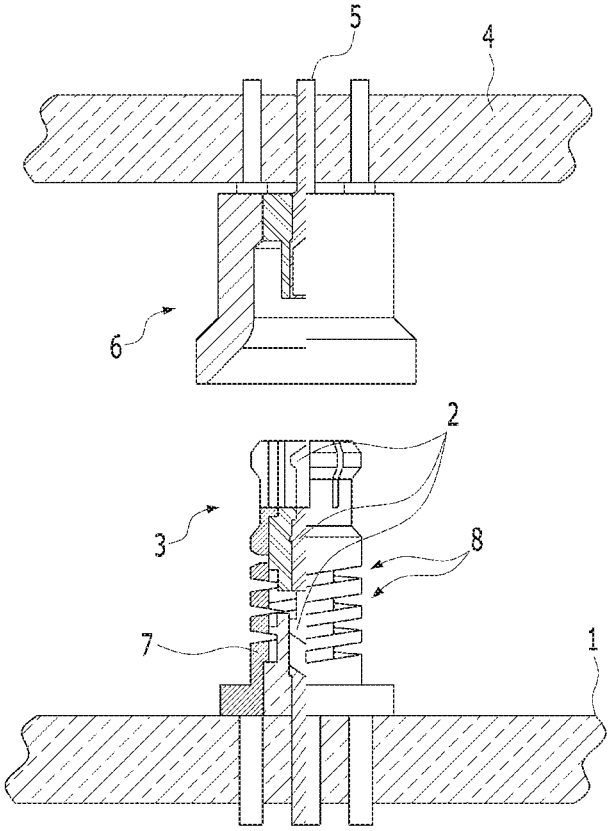
FIG. 1 (PRIOR ART)
FIG. 1 is a cross-sectional view illustrating a separation state of a board to board connector according to the related art.

The above-described purposes, features and advantages will be more clarified through the following embodiments with reference to the accompanying drawings.

The descriptions of specific structures or functions are made only to describe embodiments according to the concept of the present disclosure. The embodiments according to the concept of the present disclosure may be carried out in various manners, and it should not be interpreted that the embodiments are limited to the embodiments described in the specification of this application.

Since the embodiments according to the concept of the present disclosure can be modified in various manners and have various forms, specific embodiments will be illustrated in the drawings and described in detail in the specification of this application. However, the embodiments according to the concept of the present disclosure are not limited to the specific embodiments, but it should be understood that the embodiments include all modifications, equivalents and substitutions without departing from the scope and technical range of the present disclosure.

The terms used in the specification of this application are used only to describe a specific embodiment, and do not limit the present disclosure. The terms of a singular form may include plural forms unless referred to the contrary. In this specification, the meaning of "include" or "have" specifies a property, a number, a step, a process, an element, a component, or combinations thereof, but does not exclude one or more other properties, numbers, steps, processes, elements, components, or combinations thereof.

Hereinafter, exemplary embodiments of the present disclosure will be described with reference to the accompanying drawings in order to describe the present disclosure in detail. Like reference numerals in the drawings represent the same members.

First Embodiment

Figure 2:
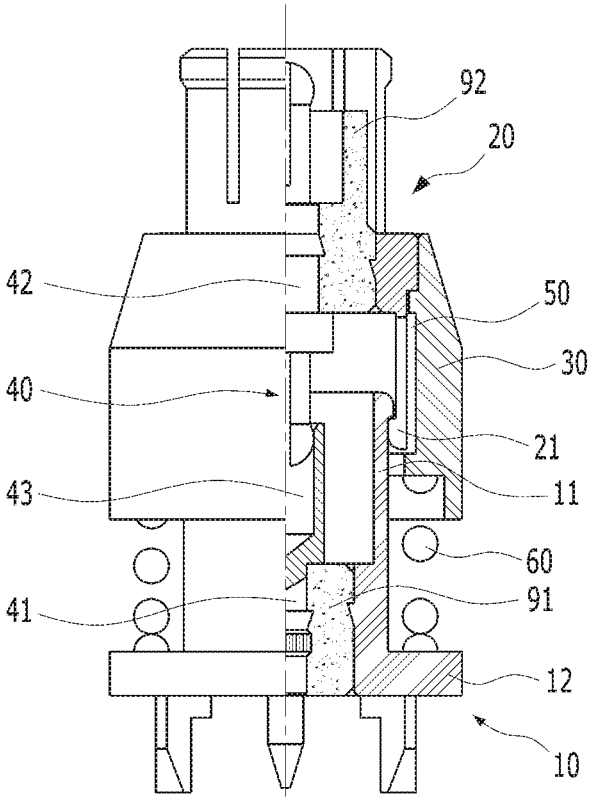
FIG. 2 is a cross-sectional view illustrating that first and second shells of a board to board connector in accordance with a first embodiment of the present disclosure are coupled to each other.
Figure 6A:
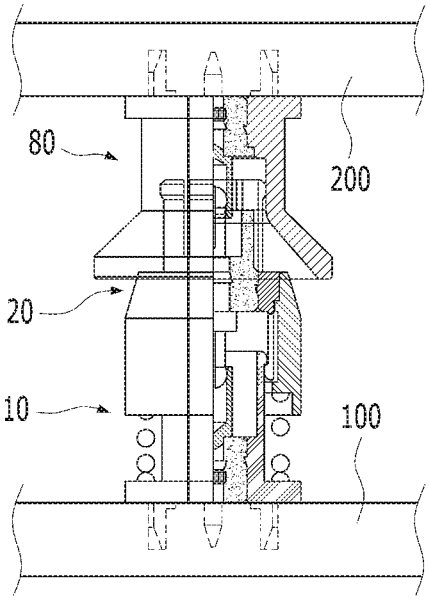
FIGS. 6A and 6B are cross-sectional views illustrating that the board to board connector in accordance with the first embodiment of the present disclosure is coupled between first and second boards and rotated.
Figure 6B:
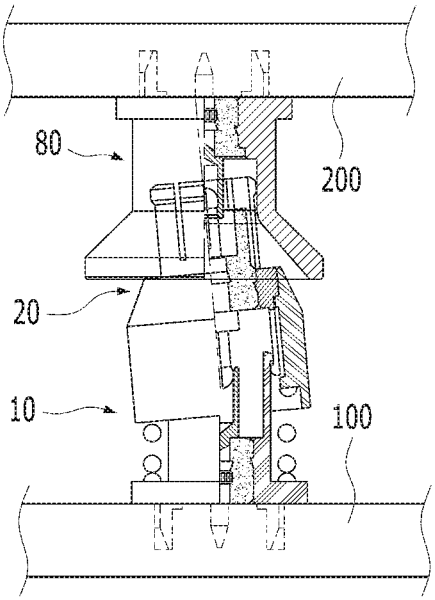

FIG. 2 illustrates a basic configuration of a board to board connector in accordance with a first embodiment of the present disclosure. FIGS. 6A and 6B illustrate that the board to board connector in accordance with the first embodiment of the present disclosure is connected between two boards. The board to board connector will be described in detail as follows.

Referring to FIGS. 2, 6A and 6B, the board to board connector in accordance with the first embodiment of the present disclosure may include a connector part and a terminal part 80. The connector part may include a first shell 10 fixed to a first board 100 and a second shell 20 coupled and fixed to the upper portion of the first shell 10 and rotated in the top-to-bottom and side-to-side directions. The terminal part 80 may be coupled and fixed to a second board 200 and inserted and fixed to the second shell 20. The second shell 20 may have a plurality of slit grooves formed at the top thereof so as to be easily inserted and fixed into the terminal part 80.

The first shell 10 may be fitted and coupled to an insertion hole of the first board 100 and have a hollow portion formed therein. The bottom of a spring 60 may be supported by the top outside of a spring cap 12 of the first shell 10, and a first insulator 91 may be disposed on the inside of the hollow portion of the first shell 10. Furthermore, a first terminal 41 may be inserted and fixed to the inside of the first insulator 91, and a second terminal 42 may be inserted and mounted in an insertion space 43 formed in the first terminal 41, and rotate the second shell 20 in the top-to-bottom and side-to-side directions with a second insulator 92 interposed therebetween.

The second insulator 92 may be disposed on the inside of the hollow portion of the second shell 20, and the second terminal 42 may be inserted and mounted in the second insulator 92, the second terminal 42 having upper and lower coupling parts 44 and 45 formed at upper and lower ends thereof, respectively.

The first and second shells 10 and 20 may be made of a conductive material and formed in a cylindrical shape, and have slots partially formed therein, the slots serving to facilitate the coupling between the first and second shells 10 and 20 or coupling to another component.

The second shell 20 includes an elastic rotating part which protrudes downward and is engaged with a cover part 30 attached on the outside of the second shell 20 toward the first shell 10 and a protruding extension part protruding upward from the first shell 10. While rotated in a movement space 50 between the elastic rotating part 21 and the cover part 30, the elastic rotating part 21 relieves an impact caused by side-to-side rotation of the second shell 20 when the first and second boards 100 and 200 are coupled through the connector.

The arrangement of the first and second terminals 41 and 42 and the engagement between the protruding extension part 11 and the elastic rotating part 21 for relieving the impact caused by the rotation of the second shell 20 will be described below in more detail.

The terminal part 80 may include a body part and an insulating part. The body part may be rotated and fastened to a through-hole formed in the second board 200 and provide a space into which the upper part of the second shell 20 is inserted and fixed. The insulating part may be inserted into the central portion of the body part and fix a terminal pin which is inserted through the central portion.

At this time, the first shell 10 may be coupled to a through-hole of the first board 100, and the terminal part 80 coupled to the second shell 20 which is inserted and fixed to the upper portion of the first shell 10 may be rotated and coupled to a tap-shaped through-hole of the second board 200.

The first shell 10 and the terminal part 80 may serve to couple the first board 100 and the second board 200 to each other. The first shell 10 and the terminal part 80 may be installed on any one of the first and second boards 100 and 200. The first or second board 100 or 200 may be a housing for communication. That is, the present embodiment may be applied to the coupling between a housing and a board or the coupling between boards.

That is, the board to board connector in accordance with the present embodiment may serve to transmit an RF signal of the board to the outside of the housing or to transfer an external RF signal to the board in the housing, while insulated from the housing.

Hereinafter, the components of the board to board connector in accordance with the present embodiment will be described in more detail.

Referring to FIGS. 2, 6A and 6B, the board to board connector in accordance with the present embodiment may include the first shell 10, the second shell 20 and a contact pin 40.

The first shell 10 may be coupled and fixed to the first board 100, and include the protruding extension part 11 extended upward in a longitudinal direction and having one end protruding in a radial direction.

The first shell 10 may have a hollow portion formed therein. Thus, the protruding extension part 11 extended upward in the longitudinal direction of the first shell 10 may also have a hollow portion formed therein. The protruding extension part 11 may be extended upward from a body part of the first shell 10, while having a smaller thickness than the thickness of the body part.

One end of the upper portion of the protruding extension part 11, facing the second shell 20, may protrude in the radial direction. As will be described below, the protruding end of the protruding extension part 11 may be formed for engagement with the elastic rotating part 21 which is extended downward from a body part of the second shell 20.

Figure 7:
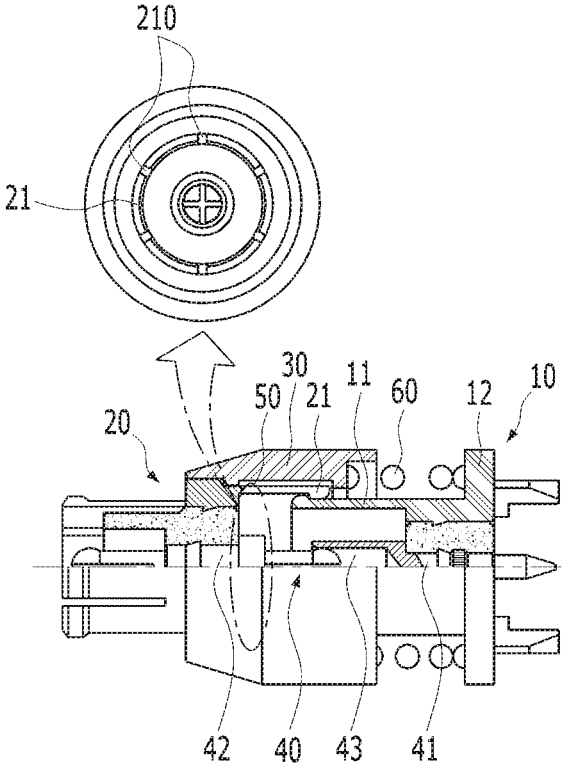
FIG. 7 is a cross-sectional view illustrating the structure of a protruding extension part of the board to board connector in accordance with the first embodiment of the present disclosure.
Figure 8A:
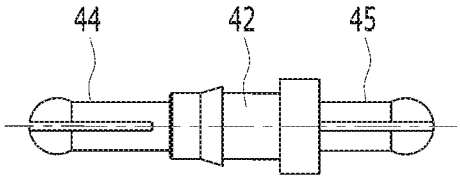
FIGS. 8A and 8B are cross-sectional views illustrating first and second terminals in accordance with the first embodiment of the present disclosure.
Figure 8B:
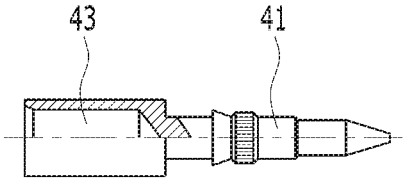

Referring to FIG. 7, the elastic rotating part 21 in accordance with an embodiment of the present disclosure may be formed of a circular elastic material to facilitate the side-to-side rotation of the second shell 20, and have one or more slots 201 formed in the longitudinal direction along the circumference thereof.

When an external force caused by the rotation of the second shell 20 is applied to the elastic rotating part 21 made of an elastic material while the protruding extension part 11 of the first shell 10 is engaged and coupled with the elastic rotating part 21 of the second shell 20, the second shell 20 may be rotated to the inside or outside by a predetermined distance through the slots 210. Thus, the second shell 20 can be effectively rotated.

In an embodiment, the plurality of slots 210 may be formed at predetermined intervals, and a random number of slots 210 may be formed at random intervals.

The shape of the slot 210 may be applied to the protruding extension part 11 of the first shell 20 as well as the elastic rotating part 21 of the second shell 20.

The elastic rotating part 21 of the second shell 20 may be extended downward in the longitudinal direction toward between the cover part 30 and the protruding extension part 11, and have the one end that protrudes in the radial direction so as to be engaged with and fixed to the protruding extension part 11.

Referring to FIG. 2, the elastic rotating part 21 may be formed on one end surface of the second shell 20, facing the first shell 10, and formed on a side of the one end surface, which is close to the cover part 30 coupled on the outside of the second shell 20. The elastic rotating part may be formed in a continuous circular shape and extended to the space between the cover part 30 and the protruding extension part 11 of the first shell 10 toward the first shell 10. However, the elastic rotating part 21 is not limited to the shape, but may include one or more slots for securing the flexibility of coupling with the protruding extension part 11. Furthermore, the elastic rotating part 21 may be formed on any one end surface of the second shell 20 so as to protrude in a rod shape, for example.

The elastic rotating part 21 may have a protrusion formed at one end thereof so as to be fitted and coupled to the protruding extension part 11 of the first shell 10. The protrusion is formed to protrude in the radial direction of the first or second shell 10 or 20. The radial direction is defined as including all directions toward the central axis or away from the central axis.

The protrusion formed at the one end of the elastic rotating part 21 of the second shell 20 may be engaged with and fixed to the protrusion formed at the one end of the protruding extension part 11 extended from the first shell 10 toward the second shell 20. For example, the protrusion of the elastic rotating part 21 may face the outside from the central axis of the connector, and the protrusion of the protruding extension part 11 may face the central axis of the connector. On the contrary, the protrusion of the elastic rotating part 21 may face the central axis of the connector, and the protrusion of the protruding extension part 11 may face the outside from the central axis of the connector. For this structure, any one of the protruding extension part 11 and the elastic rotating part 21 may have a larger radius than the other one.

The protruding extension part 11 of the first shell 10 and the elastic rotating part 21 of the second shell 20 may be extended from the first and second shells 10 and 20, respectively, and detachably attached to one end surfaces of the first and second shells 10 and 20.

As the elastic rotating part 21 of the second shell 20 is fitted and engaged with the protruding extension part 11 of the first shell 10, the second shell 20 is flexibly mounted on the upper portion of the first shell 10. Thus, since the elastic rotating part 21 and/or the protruding extension part 11 may be made of an elastic material, the elastic rotating part 21 and/or the protruding extension part 11 may enable the first and second shells 10 and 20 to flexibly rotate with respect to each other, when the two boards 100 and 200 are coupled to each other. In particular, since the elastic rotating part 21 and the protruding extension part 11 can be rotated within a predetermined space of the hollow portion of the connector in the vertical direction from the central axis of the connector, the elastic rotating part 21 and the protruding extension part 11 enable the second shell 20 and the first shell 10 to effectively and flexibly rotate in the side-to-side direction as well as the top-to-bottom direction.

Since the elastic rotating part 21 is spaced a predetermined distance from the cover part 30 and made of an elastic material, the elastic rotating part 21 can be rotated in the side-to-side direction in the movement space formed between the elastic rotating part 21 and the cover part 30. The side-to-side rotation of the elastic rotating part 21 enables the first and second shells 10 and 20 to flexibly rotate in the side-to-side direction as well as the top-to-bottom direction, when both the boards 100 and 200 are coupled through the connector, which makes it possible to provide a more stable connection of the connector.

Thus, even when an excessive coupling force is applied in the side-to-side direction while the boards are coupled, permanent deformation of the connector may not occur, and damage of the inserted pin may not be caused. For example, bending of the inserted pin can be prevented.

The contact pin 40 may be included as a central conductor in the connector, the central connector passing through the first and second shells 10 and 20.

The contact pin 40 may include the first terminal 41 and the second terminal 42. The first terminal 41 may be disposed on the inside of the first shell 10, and the second terminal 42 may be disposed on the inside of the second shell 20. Specifically, the first and second insulators 91 and 92 having a hollow portion therein may be disposed on the inside of the first and second shells 10 and 20, respectively, the first terminal 41 may be fitted into the first insulator 91, and the second terminal 42 may be fitted into the second insulator 92.

One end of the second terminal 42 may be formed in a spherical shape, and inserted and mounted into the longitudinal insertion space 43 of the first terminal 41 disposed on the inside of the first shell 10. When the two boards 100 and 200 are not horizontally aligned with each other while the two boards 100 and 200 are coupled, the second terminal 42 can be rotated in the top-to-bottom or side-to-side direction according to the top-to-bottom or side-to-side rotation of the first and second shells 10 and 20. That is, the first and second terminals 41 and 42 may be coupled to each other while the first terminal 41 is inserted into the second terminal 42. This structure may prevent damage to the contact pin 40 when the first and second shells 10 and 20 are rotated together.

Hereinafter, referring to FIGS. 3 to 5, embodiments having additional components that can facilitate the mutual rotation between the first and second shells 10 and 20 with the elastic rotating part 21 of the second shell 20, among the above-described components of the board to board connector, will be described.

The board to board connector in accordance with the first embodiment of the present disclosure may further include an additional component such as a plate spring 70 or an O-ring 71, which is installed in the movement space formed between the elastic rotating part 21 and the cover part 30, and serves as a buffer.

Figure 3:
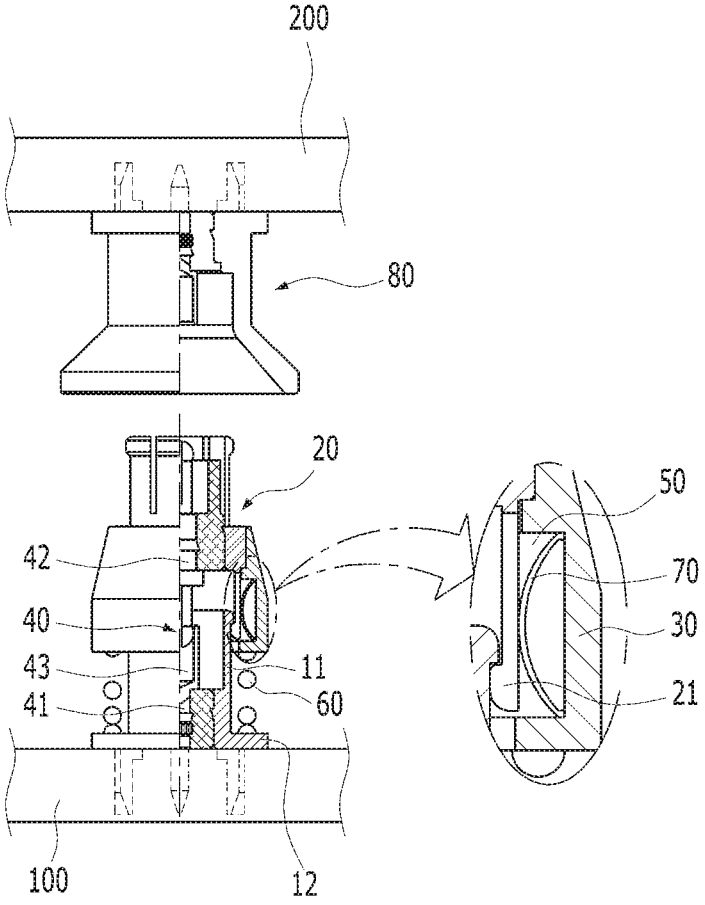
FIG. 3 is a cross-sectional view illustrating that a plate spring is disposed in the board to board connector in accordance with the first embodiment of the present disclosure.
Figure 4:
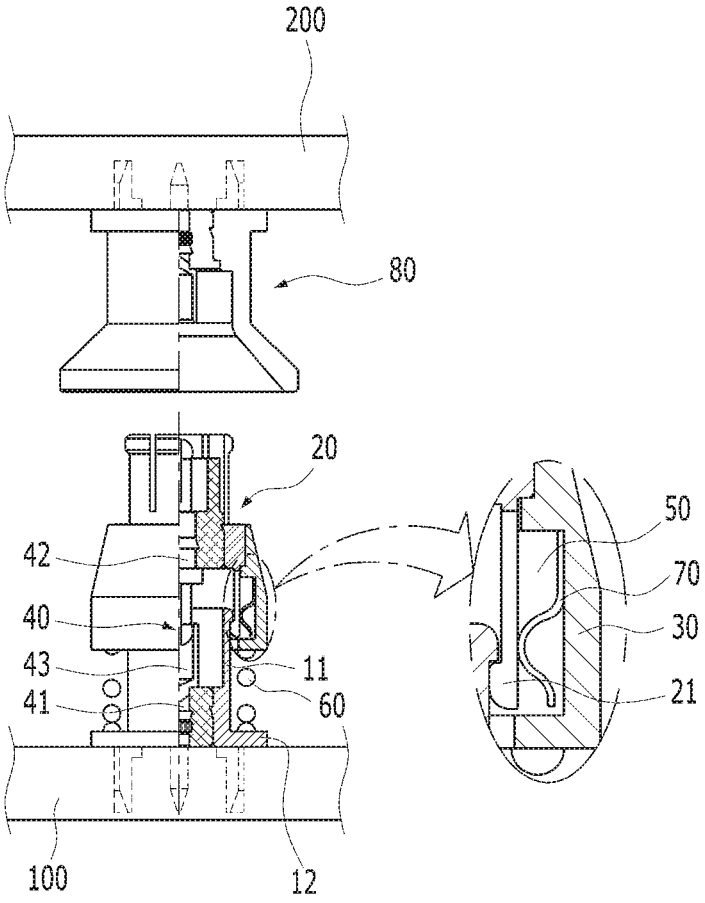
FIG. 4 is a cross-sectional view illustrating that the plate spring is disposed in the board to board connector in accordance with the first embodiment of the present disclosure.

As illustrated in FIGS. 3 and 4, the plate spring 70 may be further disposed in the movement space 50 between the elastic rotating part 21 and the cover part 30 in the board to board connector in accordance with the present embodiment.

Referring to FIG. 3, the plate spring 70 may be partially bent toward the elastic rotating part 21. When the first and second shells 10 and 20 are rotated while the two boards 100 and 200 are coupled to each other, the elastic rotating part 21 of the second shell 20, which is engaged with and fixed to the protruding extension part 11 of the first shell 10, may also be rotated to flexibly rotate the connector. At this time, pressure applied to the elastic rotating part 21 by the rotations of the first and second shells 10 and 20 may be relieved by the plate spring 70, and the plate spring 70 serves to increase the flexibility of the elastic rotating part 21.

Thus, the flexibility of the rotation of the connector can be maximized, and damage to the components of the connector, such as the elastic rotating part 21, can be prevented.

The plate spring 70 may be mounted on the inner wall of the cover part 30, and the middle portion thereof may be bent toward the elastic rotating part 21. However, the present embodiment is not limited thereto, but an arbitrary portion of the plate spring 70 may be bent toward the elastic rotating part 21, and contacted with the elastic rotating part 21.

Referring to FIG. 4, the plate spring 70 may be contacted with the inner wall of the cover part 30 up to the middle portion of the inner wall of the cover part 30, and spaced apart from the inner wall of the cover part 30 past the middle portion of the inner wall of the cover part 30, such that a portion of the plate spring 70 is bent toward the protruding one end of the elastic rotating part 21.

According to such a structure of the plate spring 70, as the first and second shells 10 and 20 are rotated, the plate spring 70 may be contacted with the one end of the elastic rotating part 21 of the second shell 20, which protrudes in the radial direction. Thus, the internal pressure of the protruding extension part 11 can be effectively distributed from the one end to the plate spring 70.

Figure 5:
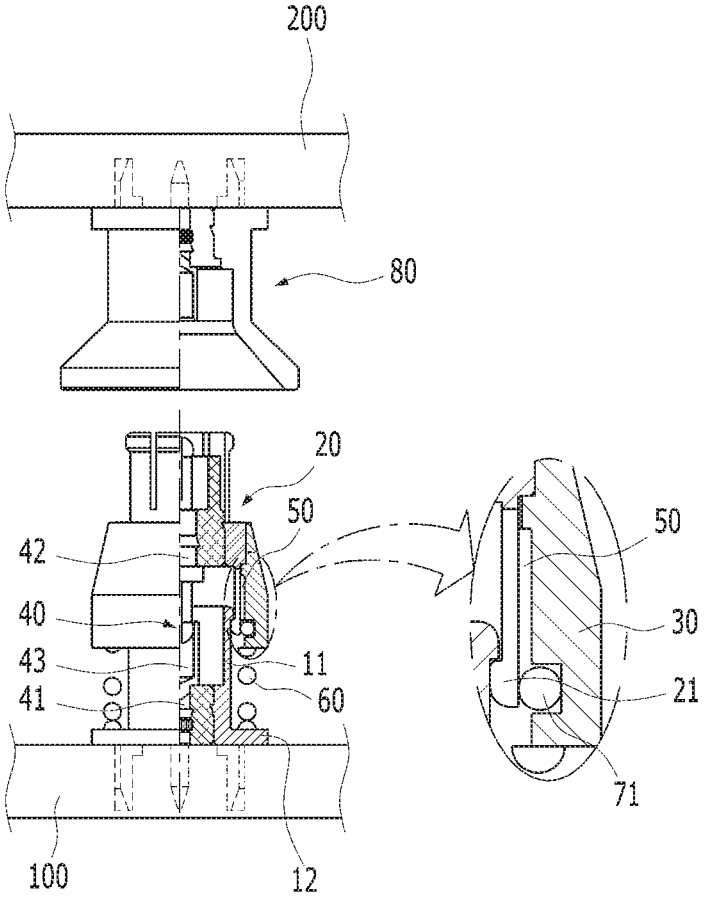
FIG. 5 is a cross-sectional view illustrating that an O-ring is disposed in the board to board connector in accordance with the first embodiment of the present disclosure.

Referring to FIG. 5, the O-ring 71 may be disposed in the movement space 50 between the elastic rotating part 21 and the cover part 30. The O-ring 71 having a simple structure may be fitted into the movement space 50, and easily relieve pressure applied to the elastic rotating part 21. One or more O-rings 71 may be disposed. The O-ring 71 may be made of an elastic material, and have a diameter set to such a value that the O-ring 71 is fitted into a recessed part formed in the inner wall of the cover part 30 and protrudes toward the elastic rotating part 21 past the inner wall.

The plate spring 70 and the O-ring 71 in accordance with the embodiments may be simultaneously disposed in the movement space 50. Furthermore, the plate spring 70 and the O-ring 71 may be disposed in an arbitrary space within the connector in order to effectively buffer pressure which occurs between the protruding extension part 11 and the elastic rotating part 21.

Second Embodiment

Figure 9:
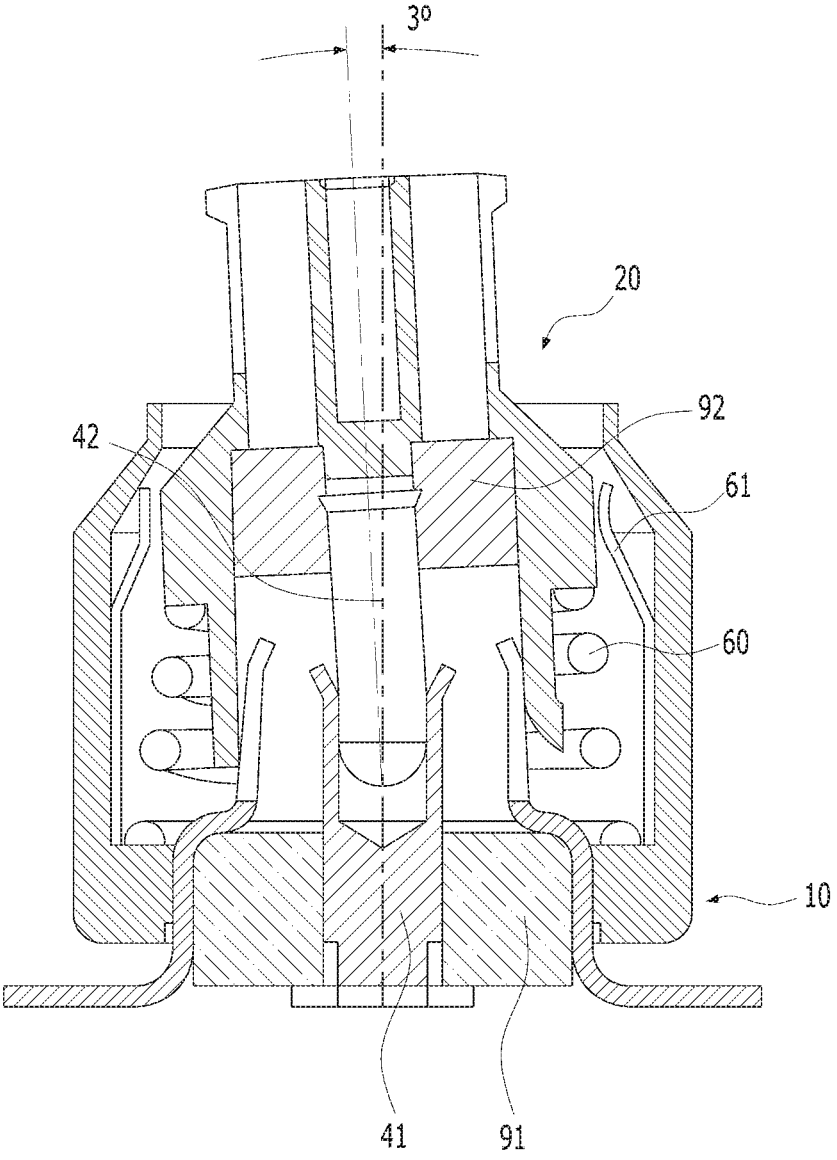
FIG. 9 is a cross-sectional view illustrating that a board to board connector in accordance with a second embodiment of the present disclosure is moved in a radial direction when boards are not horizontally aligned with each other.

Then, a board to board connector in accordance with a second embodiment of the present disclosure will be described with reference to FIG. 9. While components of the board to board connector in accordance with the second embodiment are described, the same components as those of the first embodiment will be represented by like reference numerals, and the detailed descriptions thereof will be omitted herein.

The board to board connector in accordance with the second embodiment of the present disclosure includes a first connector part and a second connector part. The first connector part includes a first shell 10 formed in a cylindrical shape and having slots partially formed therein, a first terminal 41 and a first insulator 91, and the second connector part includes a second shell 20 formed in a cylindrical shape, a second terminal 42, a second insulator 92, a spring 60 and an elastic member 61.

The second shell 20 of the second connector part may be disposed on the inside of the first shell 10 of the first connector part, and the elastic member 61 may be formed between the outer circumferential surface of the second shell 20 and the inner circumferential surface of the first shell 10. The elastic member 61 may have a press structure based on a multi-forming structure, include a plurality of slots formed therein, and have a diameter that decreases from bottom toward top.

Specifically, when the elastic member 61 having a press structure based on a multi-forming structure is operated in a radial direction, the elastic member 61 can reduce the amount of RF leakage while holding a ground. For this structure, the elastic member 61 may have a diameter that decreases from bottom toward the top. Furthermore, the elastic member 61 may have the plurality of slots formed at the top thereof, in order to facilitate internal ground contact when axial or horizontal movement is required.

Third Embodiment

Next, a board to board connector in accordance with a third embodiment of the present disclosure will be described with reference to FIGS. 10 to 14, 15A, 15B, 16A and 16B. While components of the board to board connector in accordance with the third embodiment are described, the detailed descriptions of the same components as those of the first embodiment will be omitted herein.

Figure 13:
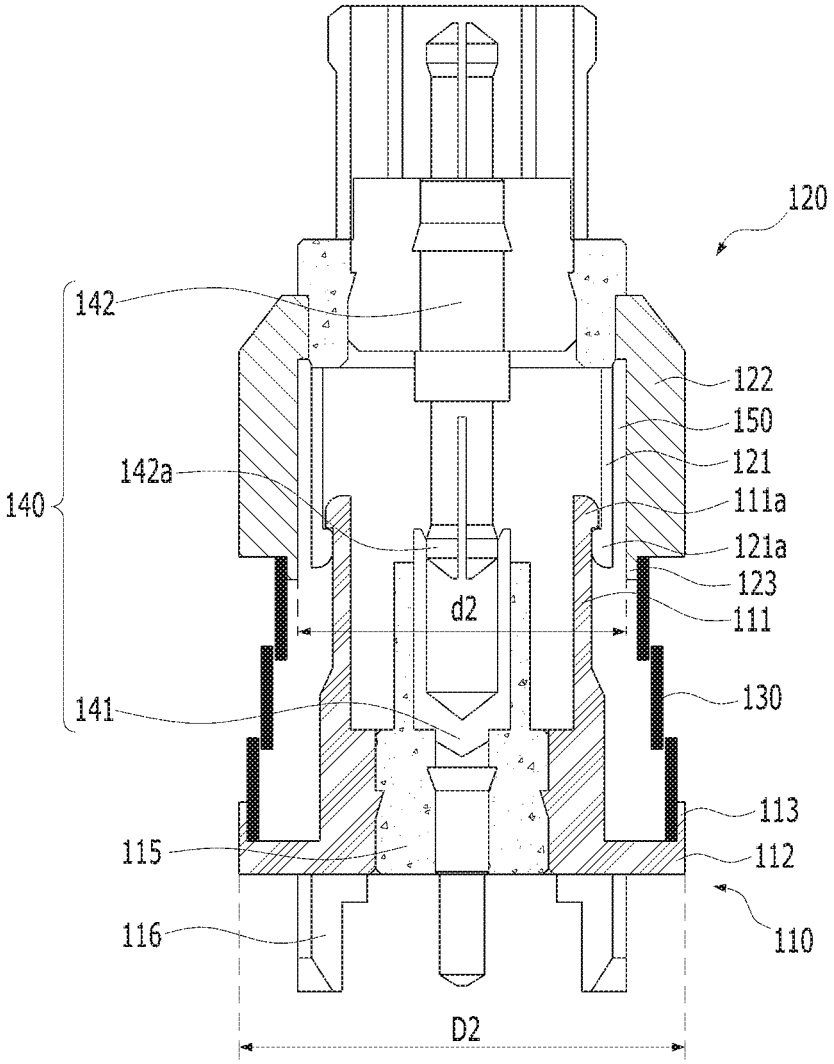
FIG. 13 is a vertical cross-sectional view illustrating the board to board connector of FIG. 10.
Figure 14:
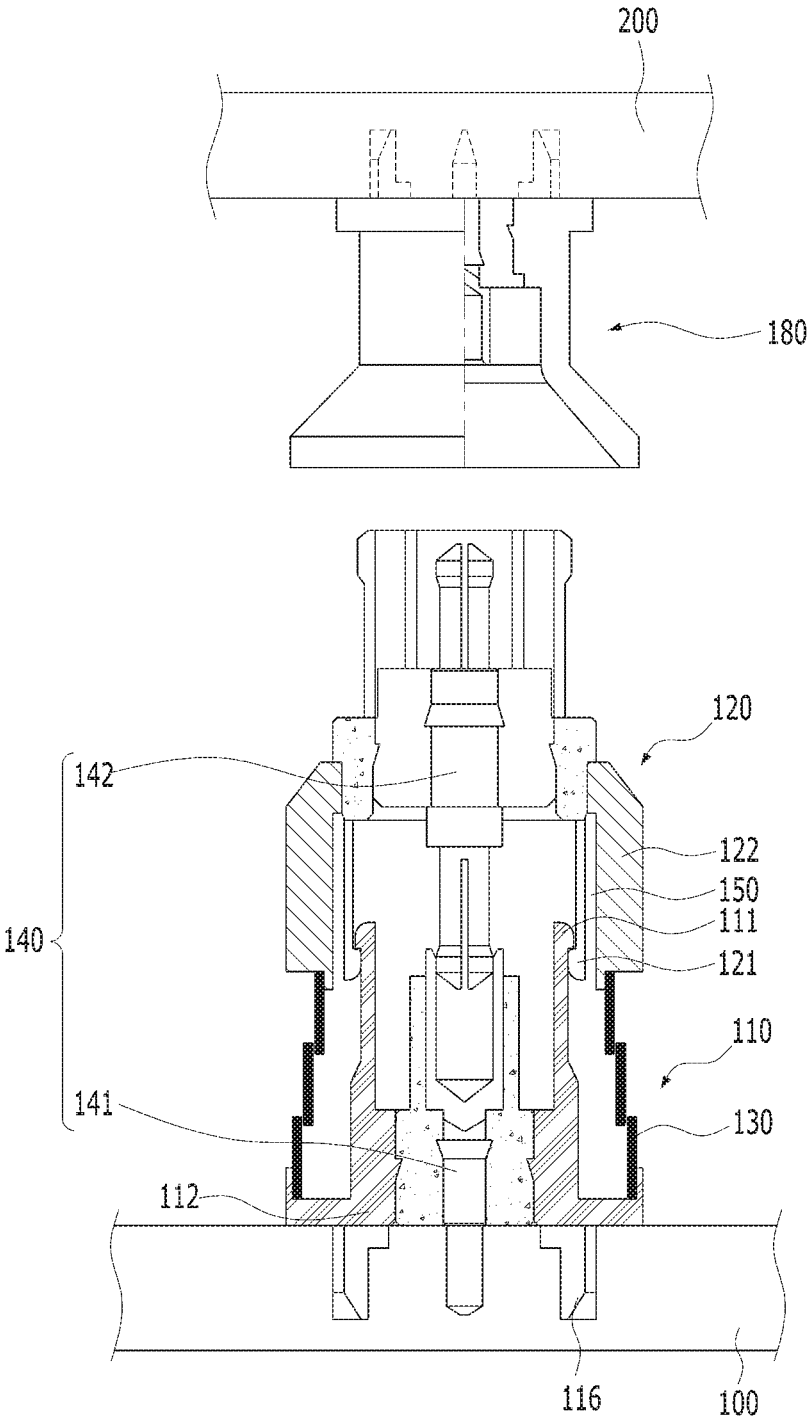
FIG. 14 is a cross-sectional view illustrating that a jack-type connector is coupled to the board to board connector in accordance with the third embodiment of the present disclosure.
Figure 15A:
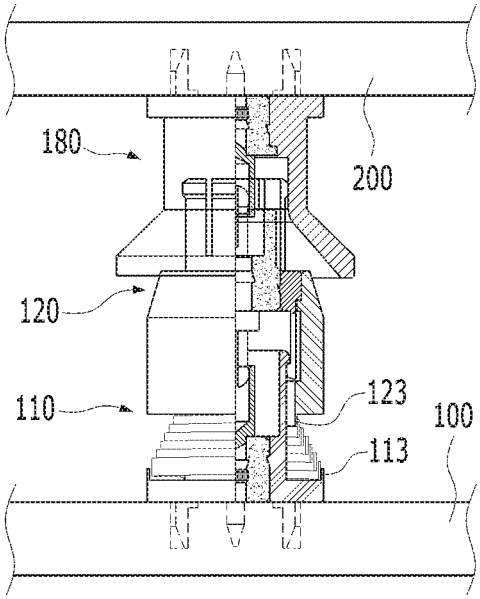
FIGS. 15A and 15B are cross-sectional views illustrating that the board to board connector in accordance with the third embodiment of the present disclosure is coupled between first and second boards and rotated.
Figure 15B:
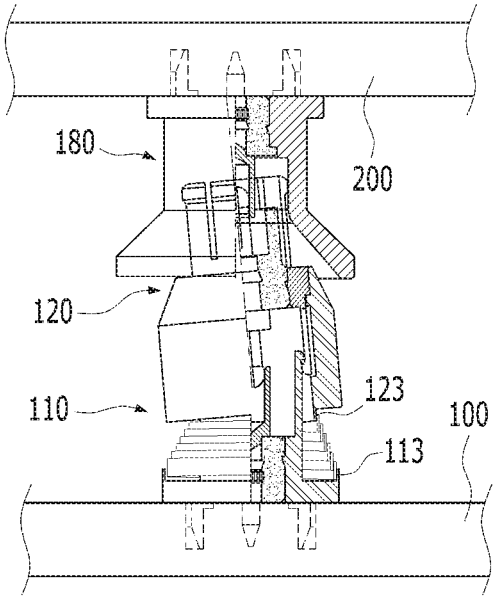
Figure 16A:
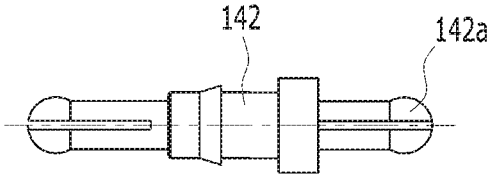
FIGS. 16A and 16B are cross-sectional views illustrating first and second terminals in accordance with the third embodiment of the present disclosure.
Figure 16B:
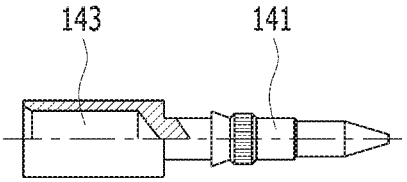

FIGS. 10 to 14 illustrate a basic configuration of the board to board connector in accordance with the third embodiment of the present disclosure, and FIGS. 15A and 15B illustrate that the board to board connector in accordance with the third embodiment of the present disclosure is connected between two boards. The board to board connector will be described in detail as follows.

As illustrated in FIGS. 14, 15A and 15B, the board to board connector in accordance with the third embodiment of the present disclosure may include a connector part and a jack-type connector part 180. The connector part may include a first shell 110 fixed to a first board 100 and a second shell 120 coupled and fixed to an upper portion of the first shell 110 and rotated in the top-to-bottom and side-to-side directions. The jack-type connector part 180 may be coupled and fixed to a second board 200 and engaged with the top of the second shell 120. The second shell 120 may have a plurality of slit grooves 126 formed at the top thereof so as to be easily engaged with the inner circumferential surface of the jack-type connector part 180.

The first and second shells 110 and 120 may be made of a conductive material and formed in a cylindrical shape, and have slots partially formed therein in order to facilitate the coupling between the first and second shells 110 and 120 or coupling to another component. Furthermore, the second shell 120 includes an elastic rotating part 121 which protrudes downward and is engaged with a cover part 122 attached on the outside of the second shell 120 toward the first shell 110 and a protruding extension part 111 protruding upward from the first shell 110. The elastic rotating part 121 may be rotated in a movement space 150 between the elastic rotating part 121 and the cover part 122. Thus, when the first and second boards 100 and 200 are coupled through the connector, the elastic rotating part 121 can relieve an impact caused by the side-to-side rotation of the second shell 120.

Figure 10:
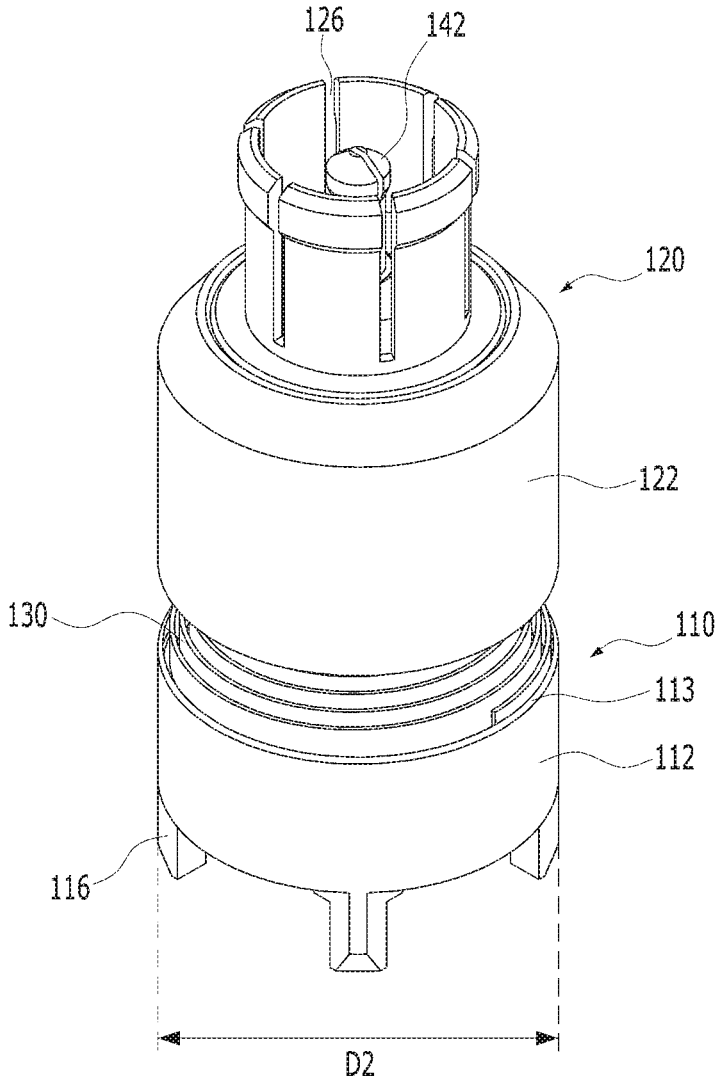
FIG. 10 is a perspective view illustrating that first and second shells of a board to board connector in accordance with a third embodiment of the present disclosure are coupled to each other.
Figure 11:
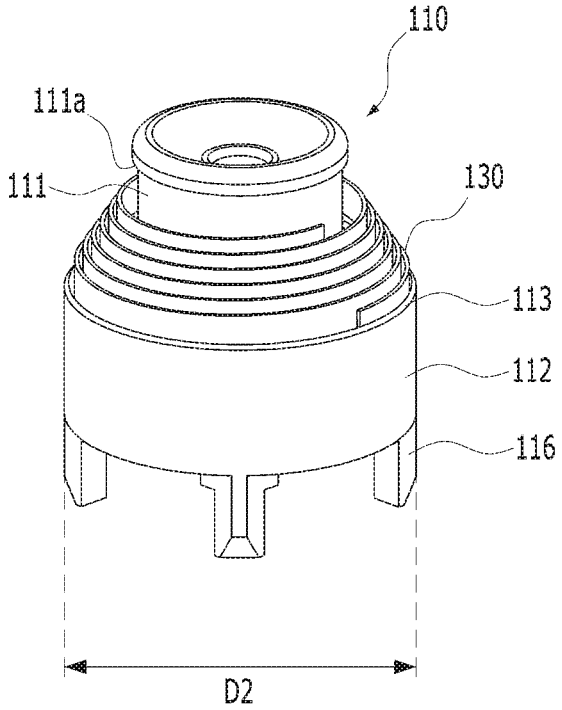
FIG. 11 is a perspective view illustrating that a volute spring is disposed in the first shell of FIG. 10.
Figure 12:
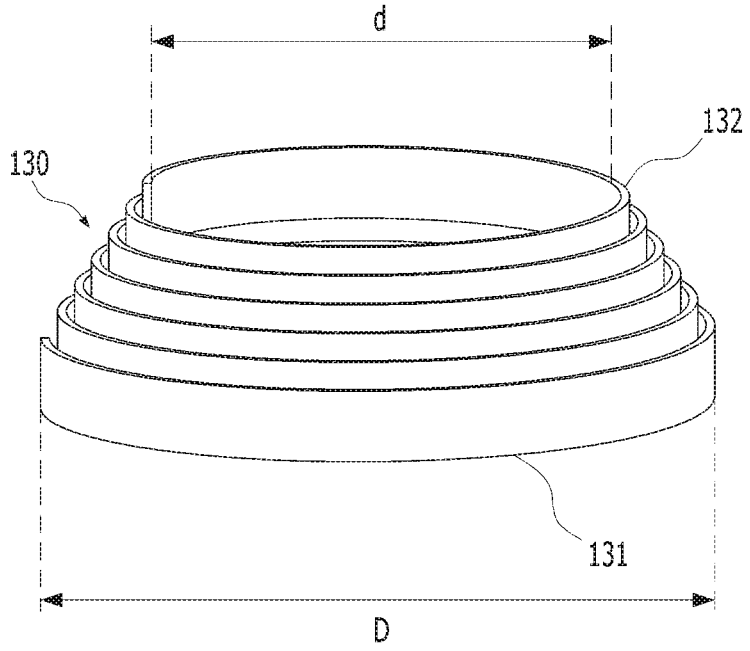
FIG. 12 is a perspective view illustrating the volute spring of the board to board connector in accordance with the third embodiment of the present disclosure.

As illustrated in FIGS. 10 and 11, the board to board connector in accordance with the third embodiment of the present disclosure includes a volute spring 130 disposed between a lower end surface of the cover part 122 of the second shell 120 and a lower flange 112 of the first shell 110, in order to push the second shell 120 upward with respect to the first shell 110. As illustrated in FIG. 12, the volute spring 130 of the board to board connector in accordance with the third embodiment of the present disclosure is a kind of cone-shaped coil spring which is a compression spring formed by winding a steel sheet with a rectangular cross-section in a cone shape. The volute spring 130 of the board to board connector in accordance with the third embodiment of the present disclosure is formed by winding a steel sheet by a plurality of turns. For example, FIGS. 11, 12, 15A and 15B illustrate the volute spring 130 formed by winding a steel sheet by six turns, and FIGS. 10, 13 and 14 illustrate the volute spring 130 formed by winding a steel sheet by three turns. However, the number of turns that the steel sheet is wound to form the volute spring 130 may be changed according to a load condition that is applied to the board to board connector.

The top of the volute spring 130 is engaged with the lower end surface of the cover part 122 of the second shell 120, and the bottom of the volute spring 130 is engaged with the lower flange 112 of the first shell 110. The inner diameter d of the volute spring 130, i.e. the inner diameter of the top thereof, may be set to a value larger than or equal to the inner diameter d2 of the lower end surface of the cover part 122 of the second shell 120, and the outer diameter D of the volute spring 130 may be set to a value smaller than or equal to the outer diameter D2 of the lower flange 112 of the first shell 110, such that the volute spring 130 can be reliably disposed between the first and second shells 110 and 120. Furthermore, in order that the top and bottom of the volute spring 130 can be reliably seated on the first and second shells 110 and 120, respectively, a first protrusion 113 may be formed on the top surface of the lower flange 112 of the first shell 110 so that the bottom of the volute spring 130 is inserted inside the first protrusion, and a second protrusion 123 may be formed on the lower end surface of the cover part 122 of the second shell 120 so as to be inserted into the top of the volute spring 130. Through such a structure, the bottom of the volute spring can be prevented from separating to the outside from the top surface of the lower flange of the first shell, and the top of the volute spring can be reliably seated on the cover part of the second shell.

When an axial load is applied downward from the second board 200 disposed at the top in the board to board connector in accordance with the third embodiment of the present disclosure, the plates of the volute spring are sequentially contacted with the left surface (the top surface of the lower flange 112 of the first shell 110) from the lowermost plate with a large spring diameter, while a buffering load (acceptable load) of the volute spring almost linearly increases with deformation of the spring. Since the plates contacted with the left surface at the bottom of the volute spring do not work as the spring, the buffering load tends to rapidly increase for a displacement under a predetermined load or more. The volute spring 130 may acquire a vibration damping effect by friction between plates contacted with each other. Such an action can protect the spring from an excessive load applied to the second board 200 disposed at the top, and allow the connector to accept a large load even in a narrow place.

The jack-type connector part 180 may be rotated and coupled to a tap-shaped through-hole formed in the second board 200, or fixed to the second board 200 through insertion or the like. The jack-type connector part 180 may include a body part providing a space engaged with the top of the second shell 120, a terminal pin inserted into the body part through the center of the body part, and an insulating part surrounding the terminal pin and fixed to the center of the body part.

The first shell 110 may be installed through a method of inserting and fixing a coupling part 116 into the first board 100 or rotating and coupling the coupling part 116 to the tap-shaped through-hole, and the second shell 120 inserted and coupled to the top of the first shell 110 may be engaged and coupled with the jack-type connector part 180.

The first shell 110 and the jack-type connector part 180 serve to couple the first board 100 and the second board 200 to each other. Each of the first shell 110 and the jack-type connector part 180 may be installed on any one of the first and second boards 100 and 200. The first or second board 100 or 200 may be a housing for communication. That is, the present embodiment may be applied to the coupling between a housing and a board or the coupling between boards.

In other words, the board to board connector in accordance with the present embodiment may serve to transmit an RF signal of the board to the outside of the housing or transfer an external RF signal to the board in the housing, while insulated from the housing.

Hereinafter, the components of the board to board connector in accordance with the third embodiment of the present disclosure will be described in more detail.

Referring to FIGS. 10 to 13, the board to board connector in accordance with the third embodiment of the present disclosure may include the first shell 110, the second shell 120 and a contact pin 140.

The first shell 110 may be coupled and fixed to the first board 100, and include the protruding extension part 111 extended upward in the longitudinal direction and having one end protruding in a radial direction.

As illustrated in FIG. 11, the first shell 110 may have a hollow portion formed therein. Thus, the protruding extension part 111 extended upward in the longitudinal direction of the first shell 110 may also have a hollow portion formed therein. The protruding extension part 111 may be extended upward from the body part of the first shell 110, while having a smaller thickness than the thickness of the body part of the first shell 110. The upper portion of the protruding extension part 111, facing the second shell 120, may have one end 111*a* protruding in the radial direction. As will be described in detail below, the protruding end 111*a* of the protruding extension part 111 may serve as a component engaged with the elastic rotating part 121 which is extended downward from the body part of the second shell 120.

As illustrated in FIG. 13, the elastic rotating part 121 in accordance with the present embodiment may be formed of a circular elastic material to facilitate the side-to-side rotation of the second shell 120, and have one or more slots (not illustrated) formed in the longitudinal direction along the circumference thereof. When an external force caused by the rotation of the second shell 120 is applied to the elastic rotating part 121 made of an elastic material while the protruding extension part 111 of the first shell 110 is engaged and coupled with the elastic rotating part 121 of the second shell 120, the elastic rotating part 121 may be rotated to the inside and outside by a predetermined distance through the slots, such that the second shell 120 can be effectively rotated. In an embodiment, the plurality of slots may be formed at predetermined intervals, and a random number of slots may be formed at random intervals. The shape of the slot may be applied to the protruding extension part 111 of the first shell 110 as well as the elastic rotating part 121 of the second shell 120. The elastic rotating part 121 of the second shell 120 may be extended downward in the longitudinal direction toward between the cover part 122 and the protruding extension part 111, and the one end of the elastic rotating part 121 may protrude in the radial direction so as to be engaged with and fixed to the protruding extension part 111.

The elastic rotating part 121 may be formed on one end surface of the second shell 120, facing the first shell 110, and formed on one side of the one end surface, which is close to the cover part 122 coupled to the outside of the second shell 120. The elastic rotating part 121 may be formed in a continuous circular shape and extended to the space between the cover part 122 and the protruding extension part 111 of the first shell 110 toward the first shell 110. The elastic rotating part 121 is not limited to the above-described shape, but may include one or more slots for securing the flexibility of coupling with the protruding extension part 111. Furthermore, the elastic rotating part 121 may be formed on one arbitrary end surface of the second shell 120, and protrude in a rod shape, for example.

The elastic rotating part 121 may have a protrusion formed at one end 121*a* thereof so as to be fitted and coupled to the one end 111*a* of the protruding extension part 111 of the first shell 110. The protrusion of the elastic rotating part 121 is formed to protrude in the radial direction of the first or second shell 110 or 120. The radial direction is defined as including all directions toward the central axis or away from the central axis.

The protrusion formed at the one end 121*a* of the elastic rotating part 121 of the second shell 120 may be engaged with and fixed to the protrusion formed at the one end 111*a* of the protruding extension part 111 extended from the first shell 110 toward the second shell 120. For example, the protrusion of the elastic rotating part 121 may face the outside from the central axis of the connector, and the protrusion of the protruding extension part 111 may face the central axis of the connector. On the contrary, the protrusion of the elastic rotating part 121 may face the central axis of the connector, and the protrusion of the protruding extension part 111 may face the outside from the central axis of the connector. For this structure, any one of the protruding extension part 111 and the elastic rotating part 121 may have a larger radius than the other one.

The protruding extension part 111 of the first shell 110 and the elastic rotating part 121 of the second shell 120 may be extended from the first and second shells 110 and 120, respectively, and detachably attached to one end surfaces of the first and second shells 110 and 120.

As the elastic rotating part 121 of the second shell 120 is fitted to and engaged with the protruding extension part 111 of the first shell 110, the second shell 120 may be mounted to be movable in the top-to-bottom and side-to-side directions over the first shell 110. Since the elastic rotating part 121 and/or the protruding extension part 111 may be made of an elastic material, the elastic rotating part 121 and/or the protruding extension part 111 enable the first and second shells 110 and 120 to freely rotate with respect to each other, when the two boards 100 and 200 are coupled to each other. In particular, since the elastic rotating part 121 and the protruding extension part 111 can be rotated in a predetermined space of the hollow portion of the connector in the vertical direction from the central axis of the connector, the elastic rotating part 121 and the protruding extension part 111 enable the second shell 120 and the first shell 110 to effectively and freely rotate in the side-to-side direction as well as the top-to-bottom direction.

Between the elastic rotating part 121 and the cover part 122, the movement space 150 may be formed. The elastic rotating part 121 made of an elastic material may be spaced a predetermined distance from the cover part 122, and rotated in the side-to-side direction in the movement space 150 formed between the elastic rotating part 121 and the cover part 122. The side-to-side rotation of the elastic rotating part 121 enables the first and second shells 110 and 120 to freely rotate in the side-to-side direction as well as the top-to-bottom direction, when the boards 100 and 200 are coupled through the connector, which makes it possible to provide a more stable connection of the connector.

Thus, even when an excessive coupling force is applied in the side-to-side direction while the boards are coupled, permanent deformation of the connector may not occur, and damage of the inserted pin may not be caused. For example, bending of the inserted pin can be prevented.

Examples of the material of the volute spring used in the board to board connector in accordance with the present embodiment may include high carbon steel, chrome steel, stainless steel, phosphor bronze, beryllium bronze and the like. However, the present embodiment is not limited thereto, but other metallic materials may be used. The volute spring may be manufactured by winding a plate-shaped spring material with a predetermined thickness and width by a predetermined number of turns such that the volute spring has a predetermined inner diameter, outer diameter and height.

The contact pin 140 may be included in the connector as a central conductor passing through the first and second shells 110 and 120. For example, the contact pin 140 may be coupled to the inside of the second shell 120 by an insulating part.

As illustrated in FIGS. 13, 15A and 15B, the contact pin 140 may include a first terminal 141 and a second terminal 142. The first terminal 141 may be disposed on the inside of the first shell 110, and the second terminal 142 may be disposed on the inside of the second shell 120. One end of the second terminal 142 may be formed in a spherical shape, and inserted and mounted into a longitudinal insertion space 143 of the first terminal 141 disposed on the inside of the first shell 110. When the two boards 100 and 200 are not horizontally aligned with each other while the two boards 100 and 200 are coupled, the second terminal 142 can be rotated in the top-to-bottom and side-to-side directions according to the top-to-bottom and side-to-side rotations of the first and second shells 110 and 120. That is, the first and second terminals 141 and 142 may be coupled to each other while the first terminal 141 is inserted into the second terminal 142. This structure may prevent damage to the contact pin 140 when the first and second shells 110 and 120 are rotated together.

In the board to board connector in accordance with the present embodiment, when the second shell 120 is moved toward the first shell 110, the one end 142*a* of the second terminal 142 may be contacted with the bottom surface of the insertion space 143 of the first terminal 141, and restrain the second shell 120 from moving downward, which makes it possible to prevent permanent deformation of the volute spring 130.

Fourth Embodiment

Next, a board to board connector in accordance with a fourth embodiment of the present disclosure will be described with reference to FIGS. 17, 18, 19A to 19C, 20, 21A and 21B. While components of the board to board connector in accordance with the fourth embodiment are described, the same components as those of the third embodiment will be represented by like reference numerals, and the detailed descriptions thereof will be omitted herein.

Figure 17:
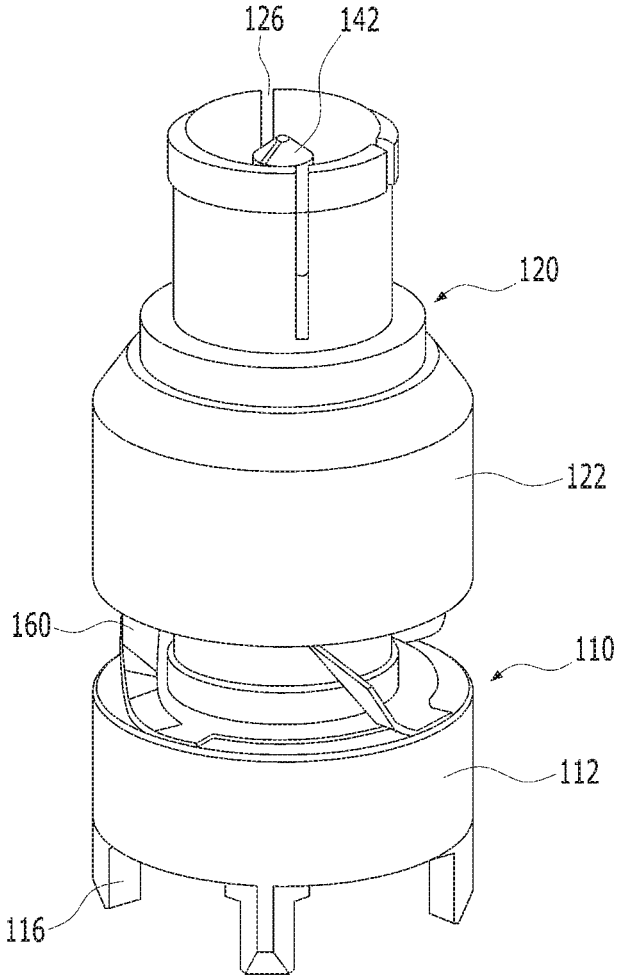
FIG. 17 is a perspective view illustrating that first and second shells of a board to board connector in accordance with a fourth embodiment of the present disclosure are coupled to each other.
Figure 20:
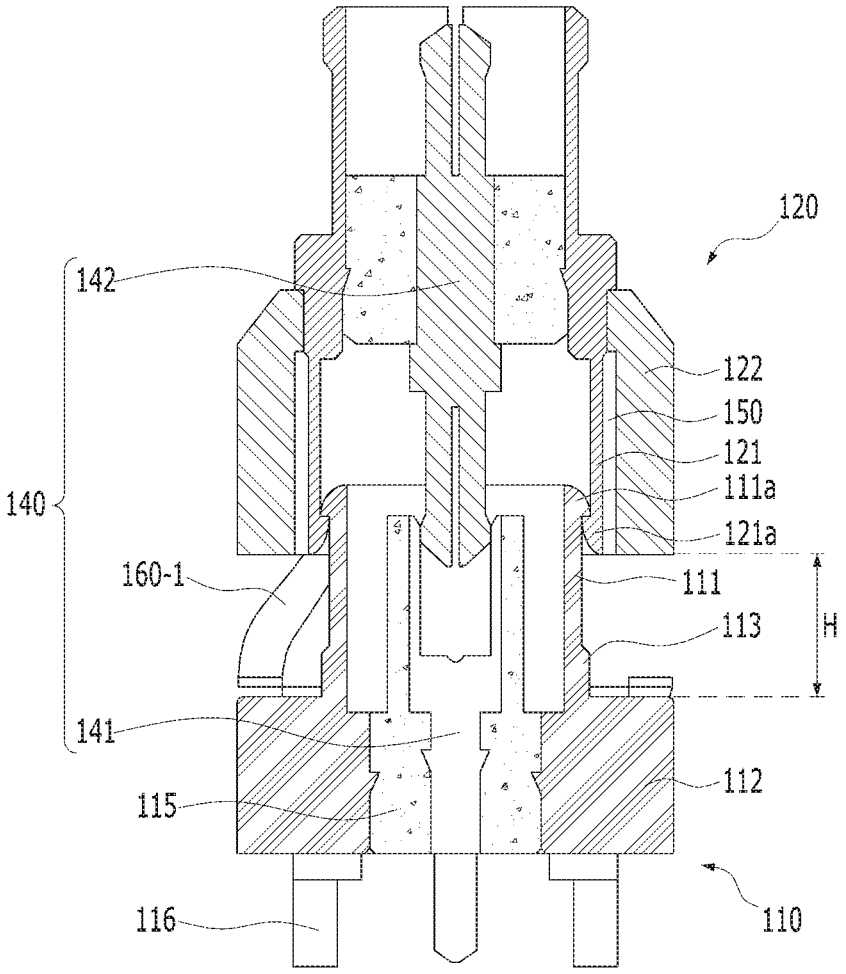
FIG. 20 is a vertical cross-sectional view illustrating the board to board connector of FIG. 17.
Figure 21A:
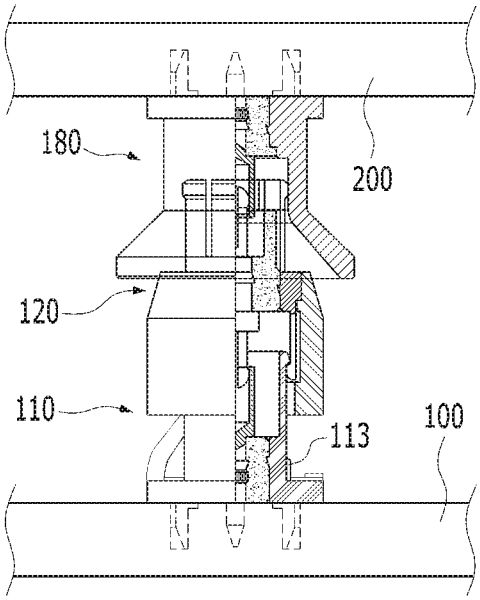
FIGS. 21A and 21B are cross-sectional views illustrating that the board to board connector in accordance with the fourth embodiment of the present disclosure is coupled between first and second boards and rotated.
Figure 21B:
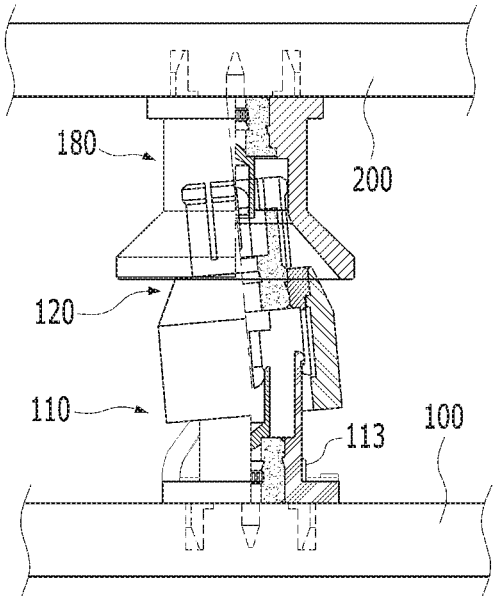

As illustrated in FIGS. 17 and 20, the board to board connector in accordance with the fourth embodiment of the present disclosure may include a connector part and a jack-type connector part 180. The connector part may include a first shell 110 fixed to a first board 100 and a second shell 120 coupled and fixed to the upper portion of the first shell 110 and rotated in the top-to-bottom and side-to-side directions, and the jack-type connector part 180 may be coupled and fixed to a second board 200 and engaged with the top of the second shell 120. The second shell 120 may have a plurality of slit grooves 126 formed at the top thereof so as to be easily engaged with the inner circumferential surface of the jack-type connector part 180.

Figure 18:
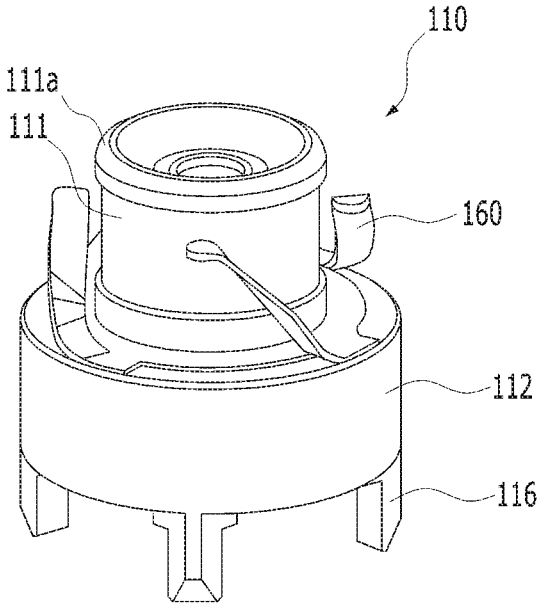
FIG. 18 is a perspective view illustrating that a plate spring is disposed in the first shell of FIG. 17.
Figure 19A:
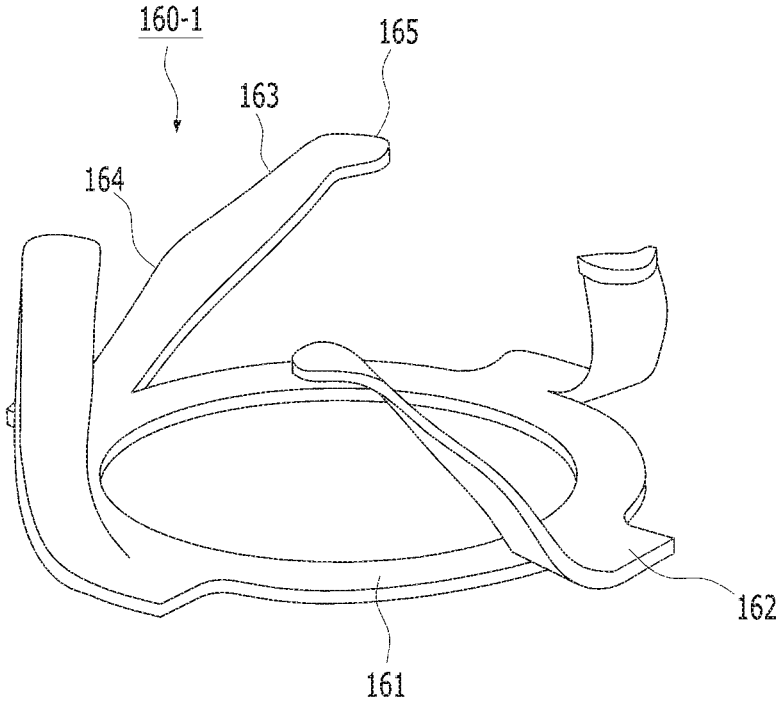
FIGS. 19A, 19B and 19C are perspective views illustrating the plate spring of the board to board connector in accordance with the fourth embodiment of the present disclosure.

As illustrated in FIGS. 17 and 18, the board to board connector in accordance with the fourth embodiment of the present disclosure includes a multipoint support plate spring 160 disposed between a lower end surface of a cover part 122 of the second shell 120 and a lower flange 112 of the first shell 110, in order to push the second shell 120 upward with respect to the first shell 110. As illustrated in FIG. 19A, a multipoint support plate spring 160-1 of the board to board connector in accordance with the fourth embodiment of the present disclosure may include an inner circular band 161, a plurality of extension parts 162 extended outward from the outer edge of the inner circular band 161, and a plurality of legs 163 protruding upward obliquely from the respective extension parts 162. In order to stably support the second shell 120, the multipoint support plate spring 160-1 may include three or more legs 163. For example, the number of the legs 163 may be set to three. Depending on the design specification, however, the number of the legs 163 may be set to four or more.

As illustrated in FIG. 19A, the inner circular band 161 serving as the bottom of the multipoint support plate spring 160-1 of the board to board connector in accordance with the fourth embodiment of the present disclosure may be disposed on the top surface of the lower flange 112 of the first shell 110. At this time, concave groove-shaped seating parts corresponding to the contour of the inner circular band 161 and the extension parts 162 may be formed at the upper end surface of the lower flange 112 of the first shell 110, such that the bottom of the plate spring 160-1 can be stably disposed on the lower flange 112 of the first shell 110 and the inner circular band 161 of the plate spring 160-1 and the plurality of extension parts 162 extended from the outer edge of the inner circular band 161 are inserted and engaged with the seating parts.

Furthermore, concave groove-shaped seating parts into which end portions 165 of the plurality of legs 163 can be inserted may be formed at the lower end surface of the cover part 122 of the second shell 120, such that the end portions 165 of the plurality of legs 163 of the multipoint support plate spring 160-1 can be stably disposed on the lower end surface of the cover part 122 of the second shell 120.

Since the multipoint support plate spring 160-1 of the board to board connector in accordance with the fourth embodiment of the present disclosure supports the load of the second shell 120 through the plurality of legs 163, the multipoint support plate spring 160-1 may have a much smaller load deviation than when a typical coil spring supports the load of the top board through a circular upper end surface. Therefore, the board disposed at the top can be maintained in parallel to the board disposed at the bottom. Desirably, the multipoint support plate spring 160-1 may have three or more legs 163. Depending on the design specification, however, the multipoint support plate spring 160-1 have four or more legs 163. For the reliability of the function that the multipoint support plate spring 160 disposed between the first and second shells 110 and 120 supports the top board in parallel to the bottom board with a small load deviation, the end portions 165 of the plurality of legs 163 of the multipoint support plate spring 160-1 in the board to board connector in accordance with the fourth embodiment of the present disclosure may be horizontally disposed. That is, the end portions 165 of the plurality of legs 163 may be disposed in parallel to the plane of the inner circular band 161.

As illustrated in FIG. 19A, the plurality of legs 163 of the multipoint support plate spring 160-1 may protrude upward obliquely from the plurality of extension parts 162 extended outward from the inner circular band, and have an inflection part 164 formed in the middle thereof, at which the slope is changed, in order to increase the load support capacity of the plate spring 160-1.

The multipoint support plate spring 160-1 of the board to board connector in accordance with the fourth embodiment of the present disclosure may be manufactured through a press forming process using beryllium copper C1720_TO.15. However, the present embodiment is not limited thereto, but the multipoint support plate spring 160-1 may be manufactured by another mechanical machining method using another metallic material.

In the board to board connector in accordance with the fourth embodiment of the present disclosure, the maximum distance H between the top surface of the lower flange 112 of the first shell 110 and the lower end surface of the cover part 122 of the second shell 120 may be set to approximately 2.6 mm. However, the present embodiment is not limited thereto, but the maximum distance H may be set to other values. In order for the second shell 120 to buffer and support a load transferred from the second board 200 disposed at the top, the multipoint support plate spring 160-1 may be contracted downward. At this time, in order to prevent permanent deformation of the multipoint support plate spring 160-1, a stopper may be installed to limit the distance by which the second shell 120 is moved toward the first shell 110. In the board to board connector in accordance with the fourth embodiment of the present disclosure, a stopper 113 may protrude outward from the outer circumferential surface of the lower end portion of the protruding extension part 111 of the first shell 110, and have a predetermined height h. The height h of the stopper 113 may be set to approximately 0.8 mm. However, the present embodiment is not limited thereto, but the height h may be set to other values.

In the board to board connector in accordance with the fourth embodiment of the present disclosure, when the second shell 120 is moved toward the first shell 110, one end 142*a* of a second terminal 142 may be contacted with the bottom surface of an insertion space 143 of a first terminal 141 and restrain the second shell 120 from moving downward, which makes it possible to prevent permanent deformation of the multipoint support plate spring 160.

Figure 19B:
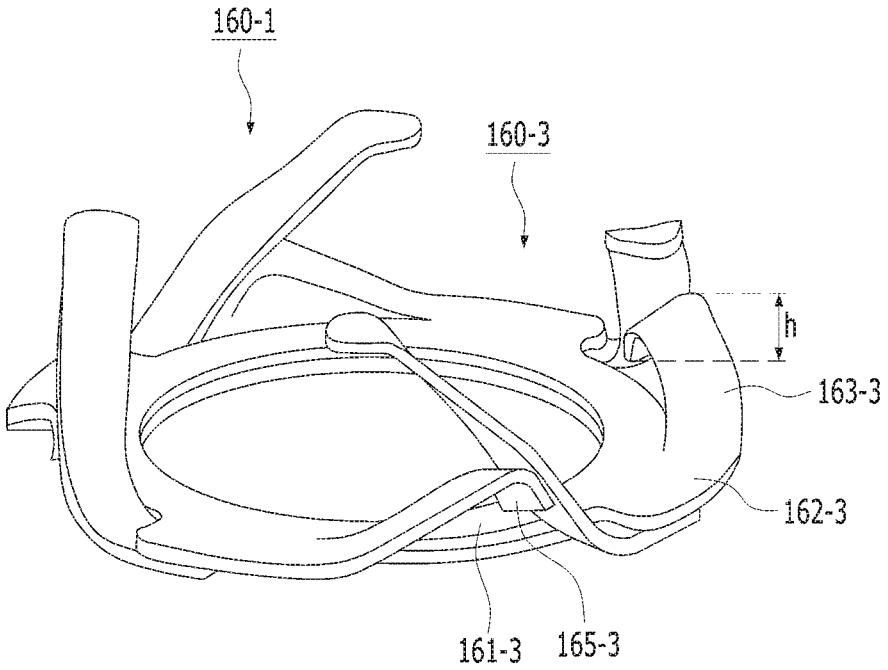

FIG. 19B illustrates a multipoint support plate spring 160-1 and a stopper spring 160-3 in a board to board connector in accordance with an embodiment of the present disclosure. Except that the stopper spring 160-3 is additionally disposed, the other components have the same structures as those of the above-described embodiment. Thus, the following descriptions will be focused on the stopper spring 160-3.

The stopper spring 160-3 includes an inner circular band 161-3, one or more extension parts 162-3 extended outward from an outer edge of the inner circular band 161-3, and one or more stoppers 162-3 protruding upward obliquely from the one or more extension parts and each having an end portion 165-3 extended downward by a predetermined length h from the peak of the stopper 163-3. The stopper spring 160-3 may be disposed over or under the multipoint support plate spring 160-1 at the top surface of the lower flange 112 of the first shell 110.

When the second shell 120 is moved toward the first shell 110, the end portion of the stopper 163-3 of the stopper spring 160-3 is contacted with the top surface of the lower flange 112 of the first shell 110, and thus serves to restrain the downward movement of the second shell 120.

The height of the stopper 163-3 of the stopper spring 160-3 is smaller than the height of the leg 163 of the multipoint support plate spring 160-1. Furthermore, the length h of the end portion extended downward from the peak of the stopper 163-3 of the stopper spring 160-3 may be set to approximately 0.8 mm. However, the present embodiment is not limited thereto, but the length h may be set to other values.

Figure 19C:
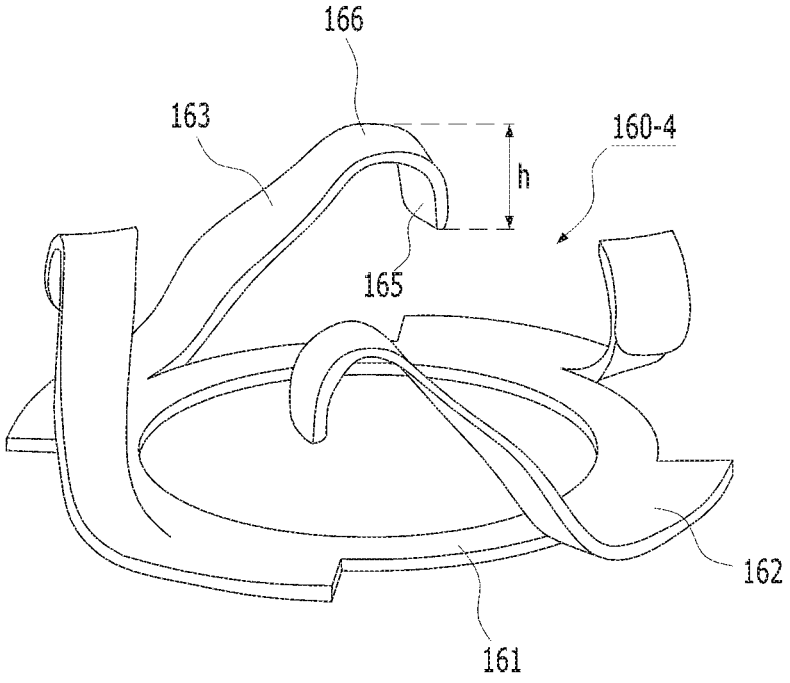

FIG. 19C illustrates a multipoint support plate spring 160-4 of a board to board connector in accordance with an embodiment of the present disclosure. The multipoint support plate spring 160-4 of the board to board connector has the same structure as the above-described multipoint support plate spring 160-1 of the board to board connector, except that one or more end portions 165 of the plurality of legs 163 are extended downward by a predetermined length h from the peak. Thus, the following descriptions will be focused on the structure that the end portions 165 of the legs 163 of the multipoint support plate spring 160-4 are extended downward.

The end portions 165 of one or more legs 163 among the plurality of legs 163 of the multipoint support plate spring 160-4 may be extended downward by the predetermined length h from the peak. In such a structure, when the second shell 120 is moved toward the first shell 110 such that the multipoint support plate spring 160-4 is contracted downward, the extended end portion 165 of the leg 163 serves as a stopper that is first contacted with the top surface of the lower flange 112 of the first shell 110 and restrains the downward movement of the second shell 120. The length h of the end portion of the leg 163, extended downward from the peak, may be set to approximately 0.8 mm. However, the present embodiment is not limited thereto, but the length h may be set to other values.

The board to board connector in accordance with the fourth embodiment of the present disclosure may include additional components which enable the first and second shells 110 and 120 to more freely rotate together, with the elastic rotating part 121 of the second shell 120.

For example, the board to board connector in accordance with the fourth embodiment of the present disclosure may further include an additional component, such as a plate spring or O-ring (not illustrated), which is disposed in a movement space 150 formed between the elastic rotating part 121 and the cover part 122 and serves as a buffer.

In an embodiment in which a plate spring is further disposed in the movement space 150 between the elastic rotating part 121 and the cover part 122, a portion of the plate spring may be bent toward the elastic rotating part 121. When the first and second shells 110 and 120 are rotated while the two boards 100 and 200 are coupled to each other, the elastic rotating part 121 of the second shell 120, which is engaged with and fixed to the protruding extension part 111 of the first shell 110, may also be rotated to allow the connector to freely rotate. At this time, pressure applied to the elastic rotating part 121 by the rotations of the first and second shells 110 and 120 may be relieved by the plate spring, and the plate spring serves to increase the flexibility of the elastic rotating part 121.

Thus, the flexibility of the rotation of the connector can be maximized, and damage to the components of the connector, such as the elastic rotating part 121, can be prevented.

The plate spring may be mounted on the inner wall of the cover part 122, and the middle portion thereof may be bent toward the elastic rotating part 121. However, the present embodiment is not limited thereto, but an arbitrary portion of the plate spring may be bent toward the elastic rotating part 121, and contacted with the elastic rotating part 121.

In an embodiment in which an O-ring is further disposed in the movement space 150 between the elastic rotating part 121 and the cover part 122, the O-ring may be fitted into the movement space 150 so as to easily relieve pressure applied to the elastic rotating part 121. In an embodiment, one or more O-rings may be disposed. The O-ring may be made of an elastic material, and have a diameter set to such a value that the O-ring is fitted into a recessed part formed in the inner wall of the cover part 122 and protrudes toward the elastic rotating part 121 past the inner wall.

The plate spring and the O-ring in accordance with the embodiments may be simultaneously disposed in the movement space 150. Furthermore, the plate spring and the O-ring may be disposed in an arbitrary space within the connector for effectively buffering pressure which occurs between the protruding extension part 111 and the elastic rotating part 121.

Fifth Embodiment

Next, a board to board connector in accordance with a fifth embodiment of the present disclosure will be described with reference to FIGS. 22 to 24. While components of the board to board connector in accordance with the fifth embodiment are described, the detailed descriptions of the same components as those of the third and fourth embodiments will be omitted herein.

Figure 22:
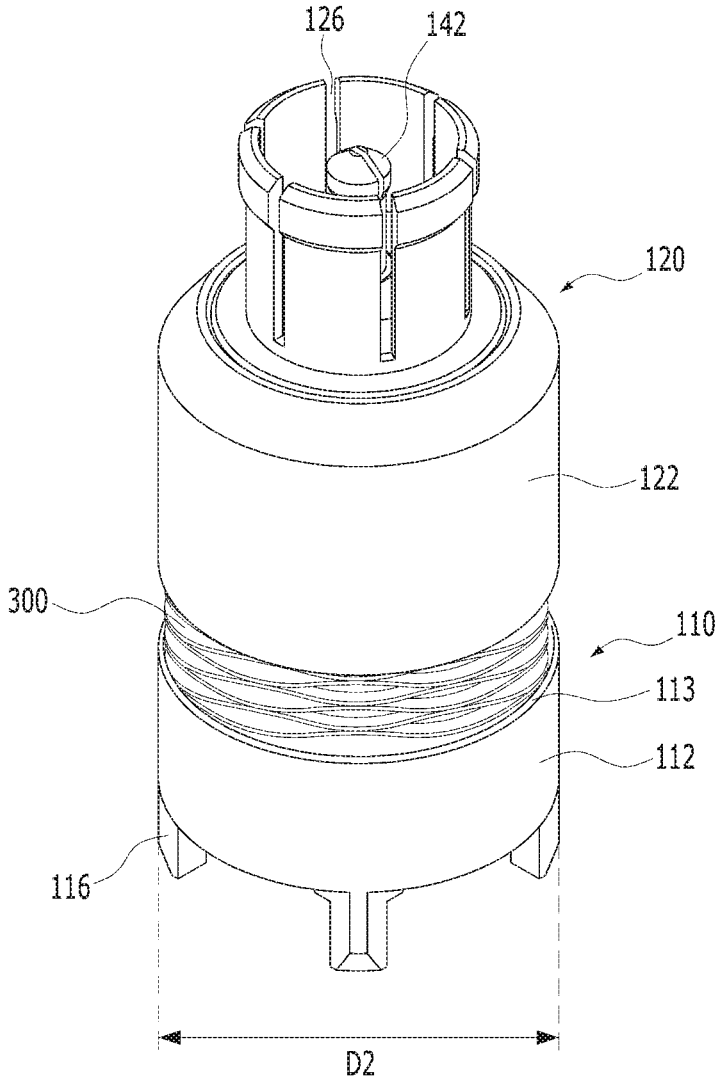
FIG. 22 is a perspective view illustrating that first and second shells of a board to board connector in accordance with a fifth embodiment of the present disclosure are coupled to each other.
Figure 23:
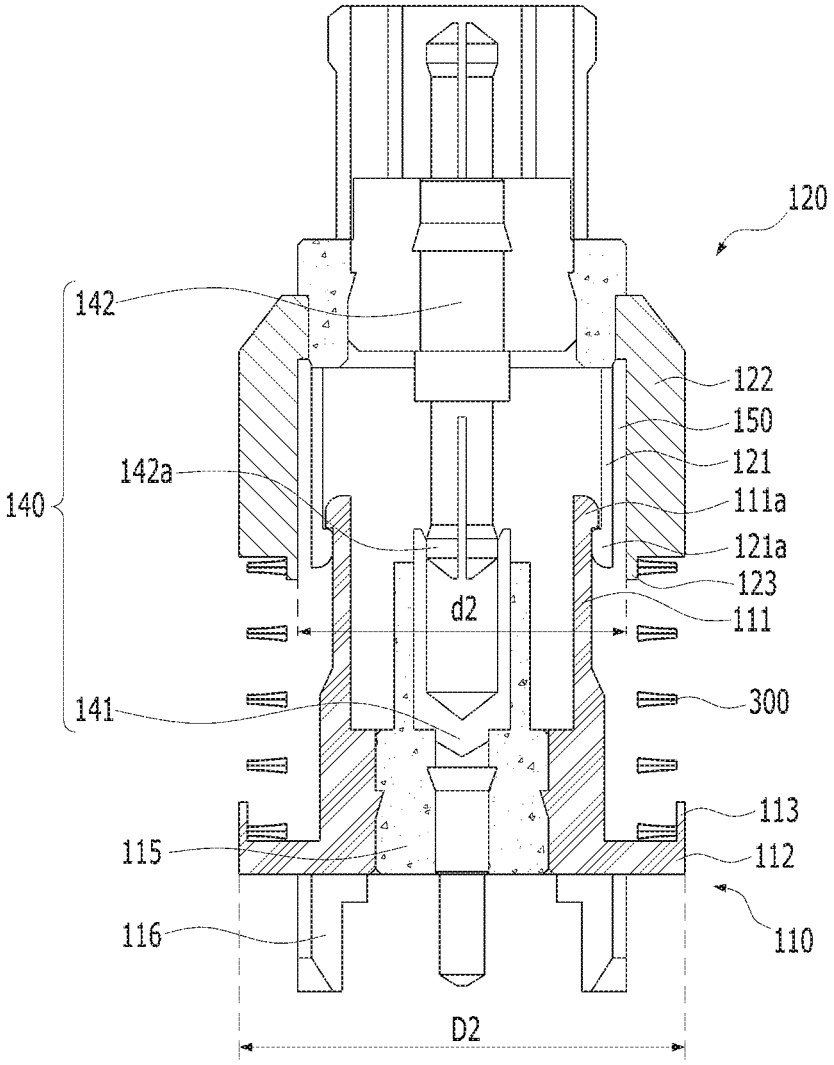
FIG. 23 is a vertical cross-sectional view illustrating the board to board connector of FIG. 22.

As illustrated in FIGS. 22 and 23, the board to board connector in accordance with the fifth embodiment of the present disclosure may include a connector part and a jack-type connector part (not illustrated). The connector part may include a first shell 110 fixed to a first board and a second shell 120 coupled and fixed to the upper portion of the first shell 110 and rotated in the top-to-bottom and side-to-side directions. The jack-type connector part may be coupled and fixed to a second board and engaged with the top of the second shell 120. The second shell 120 may have a plurality of slit grooves 136 formed at the top thereof.

The first shell 110 may include a protruding extension part 111 extended upward in the longitudinal direction and having one end protruding in a radial direction. The second shell 120 may include an elastic rotating part 121 extended downward in the longitudinal direction toward between a cover part 122 and the protruding extension part 111, and having one end protruding in the radial direction. The elastic rotating part 121 may be spaced apart from the cover part 122, and made of an elastic material.

The elastic rotating part 121 of the second shell 120 protrudes downward and is engaged with a cover part 122 attached on the outside of the second shell 120 toward the first shell 110 and the protruding extension part 111 protruding upward from the first shell 110. The elastic rotating part 121 may be rotated in a movement space 150 between the elastic rotating part 121 and the cover part 122. Thus, when the first and second boards are connected through the connector, the elastic rotating part 121 can relieve an impact caused by the side-to-side rotation of the second shell 120.

As illustrated in FIGS. 22 and 23, the board to board connector in accordance with the fifth embodiment of the present disclosure includes a wave spring 300 disposed between the lower end surface of the cover part 122 of the second shell 120 and a lower flange 112 of the first shell 110, in order to push the second shell 120 upward with respect to the first shell 110.

Figure 24:
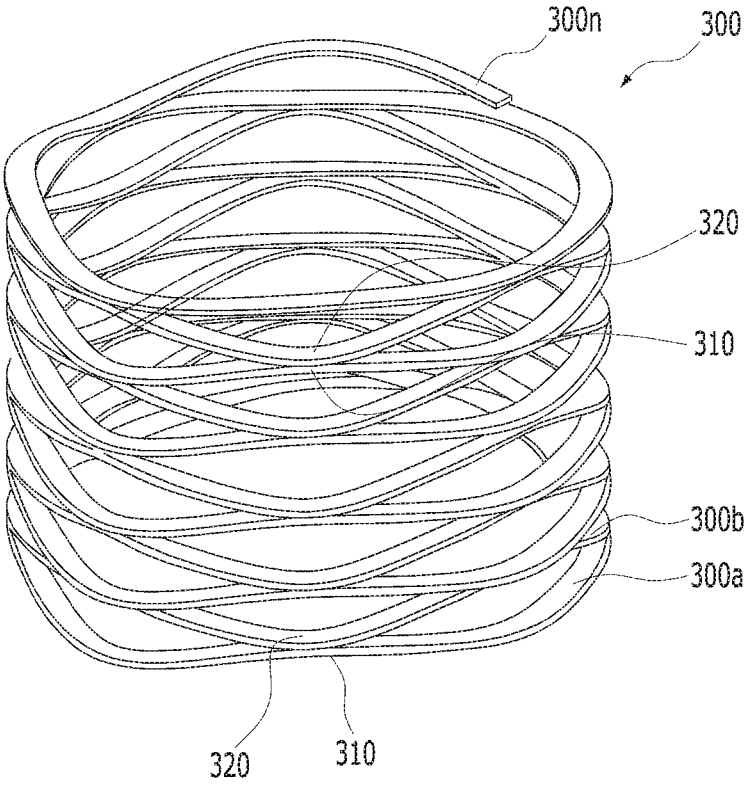
FIG. 24 is a perspective view illustrating a wave spring of the board to board connector in accordance with the fifth embodiment of the present disclosure.

As illustrated in FIG. 24, the wave spring 300 may include a plurality of unit wave springs 300*a*, 300*b*, . . . , 300*n*. The unit wave springs 300*a*, 300*b*, . . . , 300*n* may constitute a closed loop in which a plurality of first convex portion 310 and a plurality of second convex portions 320 are alternately formed. The plurality of first convex portions 310 may be upward convex, and the plurality of second convex portions 320 may be downward convex. The unit wave springs may be stacked in the vertical direction and constitute the wave spring 300 in accordance with the fifth embodiment of the present disclosure. In this case, the second convex portion 320 of the unit wave spring 300*b* disposed at the top may be coupled to the first convex portion 310 of the unit wave spring 300*a* disposed at the bottom through welding or the like.

The wave spring 300 of the board to board connector in accordance with the fifth embodiment of the present disclosure may be a single spring including a plurality of first convex portions 310 and a plurality of second convex portions 320. The first convex portions 310 may be upward convex, and the second convex portions 320 may be downward convex. At this time, the plurality of first convex portions 310 and the plurality of second convex portions 320 may be alternately disposed. The wave spring 300 may be wound by a plurality of turns. The number of turns that the wave spring 300 is wound may be changed according to a load condition applied to the board to board connector.

The top of the wave spring 300 is engaged with the lower end surface of the cover part 122 of the second shell 120, and the bottom of the wave spring 300 is engaged with the lower flange 112 of the first shell 110. In order that the upper and lower ends of the wave spring 300 can be reliably seated on the first and second shells 110 and 120, respectively, a first protrusion 113 may be formed on the top surface of the lower flange 112 of the first shell 110, and a second protrusion 123 may be formed on the lower end surface of the cover part 122 of the second shell 120.

The board to board connector in accordance with the fifth embodiment of the present disclosure may include the first shell 110, the second shell 120 and a contact pin 140.

The contact pin 140 may be included in the connector as a central conductor passing through the first and second shells 110 and 120, and include a first terminal 141 and a second terminal 142. The first terminal 141 may be disposed on the inside of the first shell 110, and the second terminal 142 may be disposed on the inside of the second shell 120.

The board to board connector in accordance with the fifth embodiment of the present disclosure may further include an additional component, such as a plate spring or O-ring (not illustrated), which is disposed in the movement space 150 formed between the elastic rotating part 121 and the cover part 122, and serves as a buffer.

In accordance with the embodiments of the present disclosure, the board to board connector can flexibly rotate in the side-to-side direction as well as the top-to-bottom direction to provide a stable connection of the connector, when two boards whose positions are difficult to check with the naked eyes are coupled.

Furthermore, the board to board connector can improve the load acceptance capacity of the spring disposed between the shells while preventing permanent deformation of the spring, even though an excessive load is applied to the connector connecting two boards.

Furthermore, even when an excessive coupling force is applied in the side-to-side direction while two boards are coupled, permanent deformation of the board to board connector may not occur, and the inserted pin may not be bent.

Furthermore, the board to board connector can improve the parallelism between the shells of the connector, thereby improving the parallelism between the two boards connected by the connector. The board to board connector can prevent relative rotation between the shells of the connector connecting the two boards.

Furthermore, the board to board connector can provide a stopper function to prevent the multipoint support plate spring from contracting by a predetermined amount or more, the multipoint support plate spring which provides a buffering force between the shells of the connector connecting the two boards.

Although various embodiments have been described for illustrative purposes, it will be apparent to those skilled in the art that various changes and modifications may be made without departing from the spirit and scope of the invention as defined in the following claims.

What is claimed is:

1. A board to board connector comprising:

a first shell coupled to a first board, and including a protruding extension part extended upward in a longitudinal direction and having one end protruding in a radial direction;

a second shell including an elastic rotating part extended downward in the longitudinal direction toward between a cover part coupled on the outside of the second shell toward the first shell and the protruding extension part of the first shell, and having one end protruding in the radial direction so as to be engaged with and fixed to the protruding extension part; and a spring disposed between the cover part of the second shell and a spring cap of the first shell, in order to rotate the second shell in a top-to-bottom direction, wherein the elastic rotating part is arranged outside the protruding extension part, and wherein the elastic rotating part is made of an elastic material, spaced apart from the cover part, and rotatable from side to side in a movement space formed between an outer circumferential surface of the elastic rotating part and an inner circumferential surface of the cover part.

2. The board to board connector of claim 1, wherein the elastic rotating part has one or more slots formed in the longitudinal direction along the circumference thereof in order to facilitate side-to-side rotation of the second shell.

3. The board to board connector of claim 1, wherein the movement space has an O-ring disposed between the elastic rotating part and the cover part.

4. The board to board connector of claim 1, further comprising a contact pin serving as a central conductor passing through the first and second shells.

5. The board to board connector of claim 4, wherein the contact pin comprises a first terminal and a second terminal, wherein the first terminal is disposed on the inside of the first shell, and the second terminal is disposed on the inside of the second shell, wherein the second terminal has one end formed in a spherical shape and inserted and mounted into a longitudinal insertion space of the first terminal, such that the second terminal is rotatable in top-to-bottom and side-to-side directions according to top-to-bottom and side-to-side rotations of the second shell.

6. A board to board connector comprising:

a first shell coupled to a first board, and including a protruding extension part extended upward in a longitudinal direction and having one end protruding in a radial direction; and a second shell including an elastic rotating part extended downward in the longitudinal direction toward between a cover part and the protruding extension part, and having one end protruding in the radial direction so as to be engaged with and fixed to the protruding extension part, wherein the elastic rotating part is made of an elastic material, spaced apart from the cover part, and rotatable from side to side in a movement space formed between the elastic rotating part and the cover part, wherein the movement space has a plate spring disposed between the elastic rotating part and the cover part.

7. The board to board connector of claim 6, wherein a portion of the plate spring is bent toward the elastic rotating part.

8. The board to board connector of claim 6, further comprising a spring disposed between the cover part of the second shell and a spring cap of the first shell, in order to rotate the second shell in a top-to-bottom direction.

9. A board to board connector comprising:

a first shell coupled to a first board, and including a protruding extension part extended upward in a longitudinal direction and having one end protruding in a radial direction;

a second shell including an elastic rotating part extended downward in the longitudinal direction toward between a cover part and the protruding extension part, and having one end protruding in the radial direction so as to be engaged with and fixed to the protruding extension part; and a volute spring disposed between a lower end surface of the cover part of the second shell and a lower flange of the first shell, in order to push the second shell upward with respect to the first shell, wherein the elastic rotating part is spaced apart from the cover part, made of an elastic material, and rotatable from side to side in a movement space formed between the elastic rotating part and the cover part, a first protrusion onto which the outside of a lower end of the volute spring is inserted is formed on a top surface of the lower flange of the first shell, and a second protrusion which is inserted into an upper end of the volute spring is formed on the lower end surface of the cover part of the second shell.

10. The board to board connector of claim 9, wherein the volute spring has an inner diameter equal to or larger than that of the lower end surface of the cover part of the second shell, and has an outer diameter equal to or smaller than that of the lower flange of the first shell.

11. The board to board connector of claim 9, further comprising a contact pin serving as a central conductor passing through the first and second shells.

12. The board to board connector of claim 11, wherein the contact pin comprises a first terminal and a second terminal, wherein the first terminal is disposed on the inside of the first shell, and the second terminal is disposed on the inside of the second shell, wherein the second terminal has one end formed in a spherical shape and inserted and mounted into a longitudinal insertion space of the first terminal, such that the second terminal is rotatable in top-to-bottom and side-to-side directions according to top-to-bottom and side-to-side rotations of the second shell.

13. A board to board connector comprising:

a first shell coupled to a first board, and including a protruding extension part extended upward in a longitudinal direction and having one end protruding in a radial direction;

a second shell including an elastic rotating part extended downward in the longitudinal direction toward between a cover part and the protruding extension part, and having one end protruding in the radial direction so as to be engaged with and fixed to the protruding extension part; and a multipoint support plate spring disposed between a lower end surface of the cover part of the second shell and a lower flange of the first shell, in order to push the second shell upward with respect to the first shell, wherein the elastic rotating part is spaced apart from the cover part, made of an elastic material, and rotatable from side to side in a movement space formed between the elastic rotating part and the cover part, the multipoint support plate spring comprises an inner circular band, a plurality of extension parts extended outward from an outer edge of the inner circular band, and a plurality of legs protruding upward obliquely from the extension parts.

14. The board to board connector of claim 13, wherein the elastic rotating part is formed of an elastic material and has one or more slots formed in the longitudinal direction along the circumference thereof in order to facilitate side-to-side rotation of the second shell.

15. A board to board connector comprising:

a first shell coupled to a first board, and including a protrusion extension part extended upward in a longitudinal direction and having one end protruding in a radial direction;

a second shell including an elastic rotating part extended downward in the longitudinal direction toward between a cover part and the protruding extension part, and having one end protruding in the radial direction so as to be engaged with and fixed to the protruding extension part; and a wave spring disposed between a lower end surface of the cover part of the second shell and a lower flange of the first shell, in order to push the second shell upward with respect to the first shell, wherein the elastic rotating part is spaced apart from the cover part, made of an elastic material, and rotatable from side to side in a movement space formed between the elastic rotating part and the cover part, the wave spring includes a plurality of unit wave springs which are stacked in the vertical direction, the unit wave springs constitute a closed loop having a plurality of first convex portions that are upward convex and a plurality of second convex portions that are downward convex, respectively, and at least one set of a first convex portion and a second convex portion corresponding to each other up and down in the unit wave springs adjacent to each other up and down is fixedly coupled.

* * * * *